US006603377B2

(12) United States Patent
Cho et al.

(10) Patent No.: US 6,603,377 B2
(45) Date of Patent: Aug. 5, 2003

(54) DOOR LOCK SWITCH ASSEMBLY IN DRUM TYPE WASHING MACHINE

(75) Inventors: Ki Chul Cho, Kyongsangnam-do (KR); Seung Bong Choi, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 246 days.

(21) Appl. No.: 09/750,492

(22) Filed: Dec. 29, 2000

(65) Prior Publication Data

US 2002/0056998 A1 May 16, 2002

(30) Foreign Application Priority Data

Dec. 29, 1999 (KR) ..... 64943/1999
Jan. 18, 2000 (KR) ..... 2202/2000

(51) Int. Cl.[7] ..... H01H 3/00; E05B 49/00

(52) U.S. Cl. ..... 335/186; 335/185; 70/277; 70/278.7

(58) Field of Search ..... 335/185, 186, 335/192; 70/275, 277, 278.7, 280, 281, 282, 283

(56) References Cited

U.S. PATENT DOCUMENTS 5,520,424 A * 5/1996 Hapke et al. ..... 292/198
5,879,036 A * 3/1999 Moline et al. ..... 292/210

* cited by examiner

*Primary Examiner*—Ramon M. Barrera
(74) *Attorney, Agent, or Firm*—Fleshner & Kim, LLP

(57) ABSTRACT

Door lock switch assembly in a drum type washing machine including a switch case, a switch cover fitted to the switch case, a latch holder rotatably, and elastically mounted in one side portion of the switch case for exerting a restoring force in a door open direction, a slide fitted to one side of the latch holder, for moving up or down in a direction the same with a hinge shaft of the latch holder to arrest or release the latch holder, a solenoid assembly mounted in a central portion of the switch case, for moving up or down the slide, and a switching part located below the slide, for making a switching operation as a terminal thereof makes a seesaw action following the moving up or down of the slide, thereby simplifying a structure of the door lock switch assembly, and improving an operation reliability of door locking and unlocking.

22 Claims, 24 Drawing Sheets

DOOR LOCK SWITCH ASSEMBLY IN DRUM TYPE WASHING MACHINE

BACKGROUND OF THE INVENTION

1. Field of the Invention

The present invention relates to a door lock switch assembly in a drum type washing machine, and more particularly, to a door lock switch assembly which has a simple structure and an improved operation reliability in locking and unlocking a door.

2. Background of the Related Art

In general, the drum type washing machine washes laundry by using friction between a drum rotated by a driving force from a motor and laundry under a state detergent, washing water, and the laundry are introduced in the drum. The drum type washing machine has advantages in that the laundry is almost not involved in damage and tangling between the laundry, and in that washing effects obtainable by beating and rubbing the laundry can be provided.

A related art drum type washing machine will be explained with reference to FIGS. 1~5. FIG. 1 illustrates an outside view of a related art drum type washing machine. Referring to FIG. 1, a tub, a water storage tank, is provided inside of a body 13, and a drum 14 is fixed at a center of the tub to be rotated by the driving motor. The drum type washing machine has a door at the front of the body 13, for introducing and taking out the laundry. And, since the detergent, washing water and laundry will gush out of the door 15 to make a floor dirty if the door 15 is opened in the middle of washing unintentionally, the related art drum type washing machine has a door lock for preventing the unintentional opening of the door 15 before it happens. The door lock has a door lock switch assembly on an inside of a front side of the body 13, and a latch 16 at a front end of an opposite side of a hinge of the door 15.

Meanwhile, as shown in FIG. 2 to FIG. 5, the related art door lock switch assembly is provided with a switch case 100, a switch cover 200 fitted to the switch case 100, a latch holder 300, a slide 400, a solenoid assembly, a switching terminal, and an operating lever 17. The latch holder 300 is rotatably fitted to the front of the switch case 100 to exert a restoring force in door unlocking direction, wherein a left side on the drawing is referred to the front and a right side thereon is referred to the rear in FIG. 2 to FIG. 4*c*. The slide 400 is fitted to the rear of the latch holder 300 in a state tilted at an angle to enable forward and backward movement perpendicular to an axis direction of the latch holder 300. The solenoid assembly has a plunger 6 press fitted inside of a clamp part 100*a* in a central portion of the switch case 100 for being drawn into a solenoid 5 to retract the slide 400 in a right direction on the drawing when the solenoid 5 is turned on. The solenoid assembly further has a compression spring 7 fitted to an outer circumference of the plunger 6 to push the plunger forward. The switching terminal has '¬' or '⊏' shape, and is fitted to the rear of the switch cover 200 to place a contact point at a side of the solenoid assembly. The operating lever 17 is hinge-coupled to a lower side of the switch cover 200 to unlock the door by manual backward moving of the slide 400.

The slide 400 has a plurality of stoppers (i.e., a first stopper 400*a,* a second stopper 400*b* and a third stopper 400*c*) at its sloped front, for arresting the latch holder 300 to prevent the latch holder 300 from returning to its original position when the door is locked. The latch holder 300 has a plurality of projections (i.e., a first projection 300*a.* a second projection 300*b.* and a third projection 300*c*) at its front end, for positioning the stoppers when the door is locked, respectively. The latch holder 300 has slots 300*d* and 300*e* between the first projection 300*a* and the third projection 300*c* of the front end of the latch holder 300, for avoiding, interference with the second stopper 400*b* and the third stopper 400*c* on the slide 400 when the latch holder 300 is rotated by a pushing force of the latch 16 as the door 15 is closed, and a slot 300*f* below the second projection 300*b* just below the upper slot 300*d* (an upper part on the drawing is referred to as an upper direction) for fitting to the second stopper 400*b* on the slide 400 when the door is locked. The latch holder 300 also has a sloped projection 300*g* at a top of the front end thereof, for pushing the slide 400 upward to tilt the slide 400 in a horizontal direction, to open a contact point of the switch in a door opening, and the slide 400 has a sloped projection 400*e* at a top of the first stopper 400*a* as a unit with the first stopper 400*a,* for being pushed by the sloped projection 300*g* on the latch holder 300 in an door opening, to tilt the slide 400 in the horizontal direction. That is to say, the latch holder 300 is provided with the sloped projection 300*g*, the first projection 300*a,* the upper slot 300*d,* the second projection 300*b* with the slot 300*f*, the lower slot 300*e*, and the third projection 300*c* formed at the front end thereof from the top to the bottom, and the slide 400 is provided with the sloped projection 400*e*, the first stopper 400*a,* the second stopper 400*b*, and the third stopper 400*b* formed at the front end thereof from the top to the bottom.

Meanwhile, there is a compression spring 18 between one point of an upper sidewall 400*f* of the slide 400 and one point at the rear of the switch case 100 higher than the one point of the upper sidewall 400*f*, for pressing the upper sidewall 400*f* of the slide 400 downward on the drawing when the slide 400 moves forward in a door locking to bring the slide 400 into a horizontal posture. The slide 400 also has a pad 400*g* below the upper sidewall 400*f* of the slide 400, for pushing a movable contact 800 to isolate from a fixed contact 900 as the slide 400 is tilted when the door lock is released.

The operating lever 17 has a knob 170 for latching a strap 12, a plurality of resilient pieces 171, and a push rod 173. When the strap 12 is pulled, the plurality of resilient pieces 171 are deformed as the resilient pieces are brought into contact with an outer surface of the switch case 100. If a force pulling the strap 12 is removed, the resilient pieces 171 return the operating lever 17 to its original position. As the resilient pieces 171 are deformed by the force applied to the strap 12, the push rod 173 rotates around a hinge shaft 172 and pushes one side of the slide 400 to the rear.

The operation of the aforementioned related art door lock switch assembly will be described. First, a door locking operation from a state the door 15 is opened will be described with reference to FIG. 1 to FIG. 2*b*.

In the door opened state as shown in FIG. 1, the door lock switch assembly is in a state as shown in FIG. 2*a*. That is to say, in the door opened state, the slide 400 is pushed upward by the sloped projection 300*g* at the top of the front end of the latch holder 300, so that the slide 400 is in a state tilted at an angle θ with respect to the horizontal direction as shown in FIG. 2*a*. In the state the door is opened thus, if the door is closed by rotating the door around the hinge shaft, the latch 16 at the front end of the door pushes the latch holder 300, so that the latch holder 300 is rotated around the hinge shaft 210 as a torsion spring 19 is deformed, elastically. As the latch holder 300 rotates thus, the sloped projection 300*g* at the top of the front end of the latch holder

300 slides along a surface of the sloped projection 400*e* of the slide 400. In this instance, as the sloped projection 300*g* leaves away from the sloped projection 400*e* gradually, the slide 400 moves in a direction the slide 400 takes a horizontal posture as the compression spring 7 pushes the upper sidewall 400*f* of the slide 400. At the same time, the second stopper 400*b* and the third stopper 400*b* projected forward from the sloped side 400*d* in the front end of the slide 400 move into the slots 300*d* and 300*e* at the front end of the latch holder 300. Then, the latch holder 300 continues rotation until a moment the slide 400 reaches to a position where interferences between the front end of the latch holder 300 and the stoppers on the slide 400 cease to exist when the slide 400 advances toward the latch holder 300 as the plunger 6 pushes the slide 400. That is to say, at the moment that interferences between the front end of the latch holder 300 and the projections on the slide 400 cease to exist, the plunger 6 advances forward by restoring force of the compression spring 7 provided on the outer surface of the plunger 6, and the slide 400 advances toward the latch holder 300 as the plunger 6 pushes the slide 400. As a result, the projections 300*a*, 300*b* and 300*c* and the slot 300*f* are brought into contact with the stoppers 400*a*, 400*b* and 400*c* on the slide 400, as shown in FIG. 2*b*. In this instance, the latch holder 300 can not return to a position where the door lock is released even though the pushing force of the latch holder 300 is eliminated as the latch holder 300 is caught by the slide 400. Under this circumstances, the latch 16 at the front end of the door 15 is located in a hook 3*a* in the latch holder 300 so that the latch 16 is subjected to a restraint of the hook 3*a*. Consequently, the door can not be opened. On the other hand, under a door locked state, i.e., in a state that the slide 400 advances to the maximum as the plunger 6 pushes the slides, with their axes positioned on the same horizontal line without any slope, the position of the movable contact 800 of the switching terminals is varied with the position of the upper sidewall 400*f*, to bring the movable contact 800 into contact with the fixed contact 900 to turn on the switch, to provide a power to the driving part, a water supply valve, and a water discharge pump (not shown) in the drum type washing machine.

A process for automatic unlocking of the door in a case a door lock release button is pressed to provide a power to the solenoid assembly in a door locked state will be described with reference to FIG. 2*b*. and FIGS. 3*a* to FIG. 3*c*.

As shown in FIG. 2*b*, the contact point is in a closed state in a door locked state, to allow the power provided to the solenoid assembly. If the user pushes a door lock release button(not shown), the power is provided to the solenoid 5. Then, the plunger 6 compresses a coil spring around the plunger 6 as the solenoid 5 draws the plunger 6, and moves away from the latch holder 300. In this instance, the plunger 6 moving away from the latch holder 300 allows the slide 400 pushed in the same direction, such that the respective stoppers 400*a*, 400*b* and 400*c* on the slide 400 in contact with the projections 300*a*, 300*b* and 300*c* and the slot 300*f* to hold rotation of the latch holder 300 escape from the projections 300*a*, 300*b* and 300*c* and the slot 300*f* at a certain moment. At the moment the respective stoppers 400*a*, 400*b* and 400*c* escape from the projections 300*a*, 300*b* and 300*c* and the slot 300*f*, the latch holder 300 returns to the door opened state by restoring force of the torsion spring 11. In other words, as shown in FIG. 3*a*, at a door lock release by the solenoid assembly, the plunger 6 is retracted to come into contact with a rear wall of the slide 400, and push the slide 400 backward, until the latch holder 300 passes through a state in FIG. 3*b* in which the latch holder 300 is about to escape from an interference of the slide 400 when the latch holder 300 is released from the restraint of the slide 400, such that the latch holder 300 is rotated by the restoring force of the torsion spring 11, to open the door. In a word, the slide 400 is pushed backward by the plunger 6 when the plunger 6 moves backward according to action of the solenoid 5 until the slide 400 and the latch holder 300 are freed from the interference completely, when the latch holder 300 returns to the door opened position, to release the latch 16 from the hook 3*a* of the latch holder 300, thereby unlocking the door.

Meanwhile, in the aforementioned door unlocking operation, the slide 400 is pushed upward by the sloped projection 300*g* at the top of the front end of the latch holder 300 at the moment the slide 400 is released from the latch holder 300, when the slide 400 is tilted at an angle θ with respect to the horizontal line as shown in FIG. 3*c* in the same manner as that of FIG. 2*a*. In this door lock release, as the slide 400 is pushed upward by the sloped projection 300*a*, the movable contact 800 in contact with the fixed contact 900 is moved away from the fixed contact 900 as the pad 400*g* on the slide 400 pushes the movable contact 800, so that the contact points between the fixed contact 900 and the movable contact 800 are opened. As the contact points between the fixed contact 900 and the movable contact 800 are thus opened, no power can be provided to the driving part, the water supply valve and the water discharge pump in the washing machine.

Different from the foregoing operation, there may be a case when it is required to release the door lock in a state the power to the washing machine is cut off due to power failure or disorder thereof, when a cover 20 at one side of a lower part of front of the drum type washing machine is opened and the strap 12 inside of the cover 20 is pulled, to activate the door lock switch assembly for releasing the door lock manually, which operation will be described with reference to FIG. 4*a* to FIG. 4*c*. As shown in FIG. 4*a*, in the state that the door is locked, when the strap 12 is pulled by the user, the operating lever 17 is rotated around the hinge shaft 172 in a clockwise direction on the drawing, when the push rod 173 formed as a unit with the operating lever 17 pushes the slide 400 backward until the interference between the slide 400 and the latch holder 300 is released as shown in FIG. 4*b*, when the latch holder 300 returns to its original position by restoring force of the torsion spring 19, thereby unlocking the door as shown in FIG. 4*c*. Meanwhile, if the force is applied to the operating lever 17 no more after the door is unlocked, the operating lever 17 returns to its original position, because ends of the resilient pieces 171 extended from the hinge of the operating lever are in contact with the lower side of the switch case 100.

However, the related art door lock switch assembly has the following problems in view of structure and a reliability of operation.

First, the construction of interference and interference release between the latch holder 300 and the slide 400 to unlock the door is complicate. In other words, the slide 400 is required to be provided with the plurality of stoppers 400*a*, 400*b* and 400*c* at its front for stopping the latch holder 300, and the sloped projection 400*e* having the sloped side for positioning an axis of the slide 400 on the same line with an axis of the plunger 6 in a door locking, and positioning the axis of the slide 400 tilted at an angle with respect to the axis of the plunger 6 in a door locking release.(see FIG. 5). The compression spring 18 provided between one point of the upper sidewall 400*f* of the slide 400 and one point at the rear of the switch case 100 presses the upper sidewall 400*f* downward on the drawing when the slide 400 advances to lock the door. In this instance, since direction of a pressing force of the compression spring 18 is not coincident with its axis, transmission of the pressing force is not effective. In addition to this, the latch holder 300 is required to be provided with the plurality of projections 300*a,* 300*b* and 300*c* and the slot 300*f* for being caught at the stoppers 400*a,* 400*b* and 400*c* at the front portion of the slide 400 in a door locking, and the sloped projection 300*g* at the top thereof to press the sloped projection 400*e* upward to displace the slide 400, that turns off the switch. (see FIG. 5).

Second, since the related art door lock switch assembly has a complicated switching operation system, an operation system of the movable contact 800 and the fixed contact 900 is also complicate. In other words, the switching operation system of the movable contact 800 and fixed contact 900 is complicate since a direction of the switching operation of the movable contact 800 and fixed contact 900 is conducted, not coincident with the axis of the plunger 6, but perpendicular to the axis of the plunger, and has a very complicate terminal fastening construction in the switch case since the contact point is located on a side of the solenoid 5 and a power supply terminal is located in the rear end of the switch case, that requires the terminal to be very long and L bent. And, to open the contacts between the movable contact 800 and the fixed contact 900 in the event the slide 400 moves backward, the switching operation system of the movable contact 800 and fixed contact 900 is required to be provided with the pad 400*g* for directly pressing, and displacing the movable contact 800 because the switching action is made perpendicular to the axis of the plunger 6. Accordingly, the fastening structure of the movable contact 800 and the fixed contact 900 provided in the switch case 100 also becomes very complicate, and the structure of the latch holder and the slide becomes complicate, thereby deteriorating component fabrication and assembly. Furthermore, the lengthy terminals of the movable contact 800 and the fixed contact 900 pushes cost up.

Third, the related art door lock switch assembly requires a large force for operation of the operating lever when the door 15 is unlocked manually from a door locked state since a pulling force is exerted indirectly in making a rotation centered on a hinge shaft of the operating lever 17. In other words, the operating force applied to the strap 12 is transferred to the slide 400, not directly, but only when the resilient pieces 171, which are formed as a unit with the operating lever and has fore ends in contact with the bottom of the switch case 100, are deformed, when the end of the push rod 173 is made to push the slide 400. In particular, as deformation of the resilient pieces becomes the greater, resisting power of the resilient pieces becomes the greater, the pulling force on the strap 12 is required to be the greater until the door is unlocked.

As described, the related art door lock switch assembly has problems in that the operation system for locking and unlocking the door is complicate and, consequently, structures of individual components are also complicate, thereby causing difficulty in shaping molds and the followed process, and in assembly, and an operation reliability is deteriorated.

SUMMARY OF THE INVENTION

Accordingly, the present invention is directed to a door lock switch assembly in a drum type washing machine that substantially obviates one or more of the problems due to limitations and disadvantages of the related art.

An object of the present invention is to provide a door lock switch assembly in a drum type washing machine which has a simple structure and an improved operation reliability when locking and unlocking a door.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the door lock switch assembly in a drum type washing machine includes a switch case, a switch cover fitted to the switch case, a latch holder rotatably, and elastically mounted in one side portion of the switch case for exerting a restoring force in a door open direction, a slide fitted to one side of the latch holder, for moving up or down in a direction the same with a hinge shaft of the latch holder to arrest or release the latch holder, a solenoid assembly mounted in a central portion of the switch case, for moving up or down the slide, and a switching part located below the slide, for making a switching operation as a terminal thereof makes a seesaw action following the moving up or down of the slide.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 3*a* to 3*c* are rear views showing the operation for unlocking a door in the related art door lock switch assembly, in which FIG. 3*a* shows a state that a plunger is retracted to push a slide to the rear by action of a solenoid assembly, FIG. 3*b* shows directly before unlocking a door, and FIG. 3*c* shows after unlocking the door;

FIGS. 4*a* to 4*c* are rear views showing the operation for manually unlocking a door in the related art door lock switch assembly, in which FIG. 4*a* shows before operating force is applied to an operating lever for manually unlocking the door. FIG. 4*b* shows directly before the door is unlocked by the operating force applied to the operating lever, and FIG. 4*c* shows after unlocking the door;

FIGS. 7*a* and 7*b* are rear views showing the operation for locking a door in a door lock switch assembly according to the present invention, in which FIG. 7*a* shows when a door is opened and FIG. 7*b* shows after a door is locked;

FIGS. 8*a* to 8*c* are rear views showing the operation for unlocking a door in a door lock switch assembly according to the present invention, in which FIG. 8*a* shows a state that a plunger is retracted to push a slide to the rear by action of a solenoid assembly, FIG. 8*b* shows directly before unlocking a door, and FIG. 8*c* shows after unlocking the door;

FIGS. 9*a* to 9*c* are rear views showing the operation for manually unlocking a door in the door lock switch assembly according to the present invention, in which FIG. 9*a* shows directly before operating force is applied to an operating lever for manually unlocking the door, FIG. 9*b* shows directly before a door is unlocked by operating force applied to an operating lever, and FIG. 9*c* shows after unlocking a door;

FIGS. 12*a* and 12*b* shows a structure of another switching part in a door lock switch assembly according to the present invention, in which FIG. 12*a* shows a contact point when a door is locked and FIG. 12*b* shows a contact point when a door is unlocked:

FIG. 13 is a sectional view showing connection state of a switch pushing piece and a movable contact, taken along line I—I of FIG. 12*a.

DETAILED DESCRIPTION OF THE PREFERRED EMBODIMENT

Figure 1:
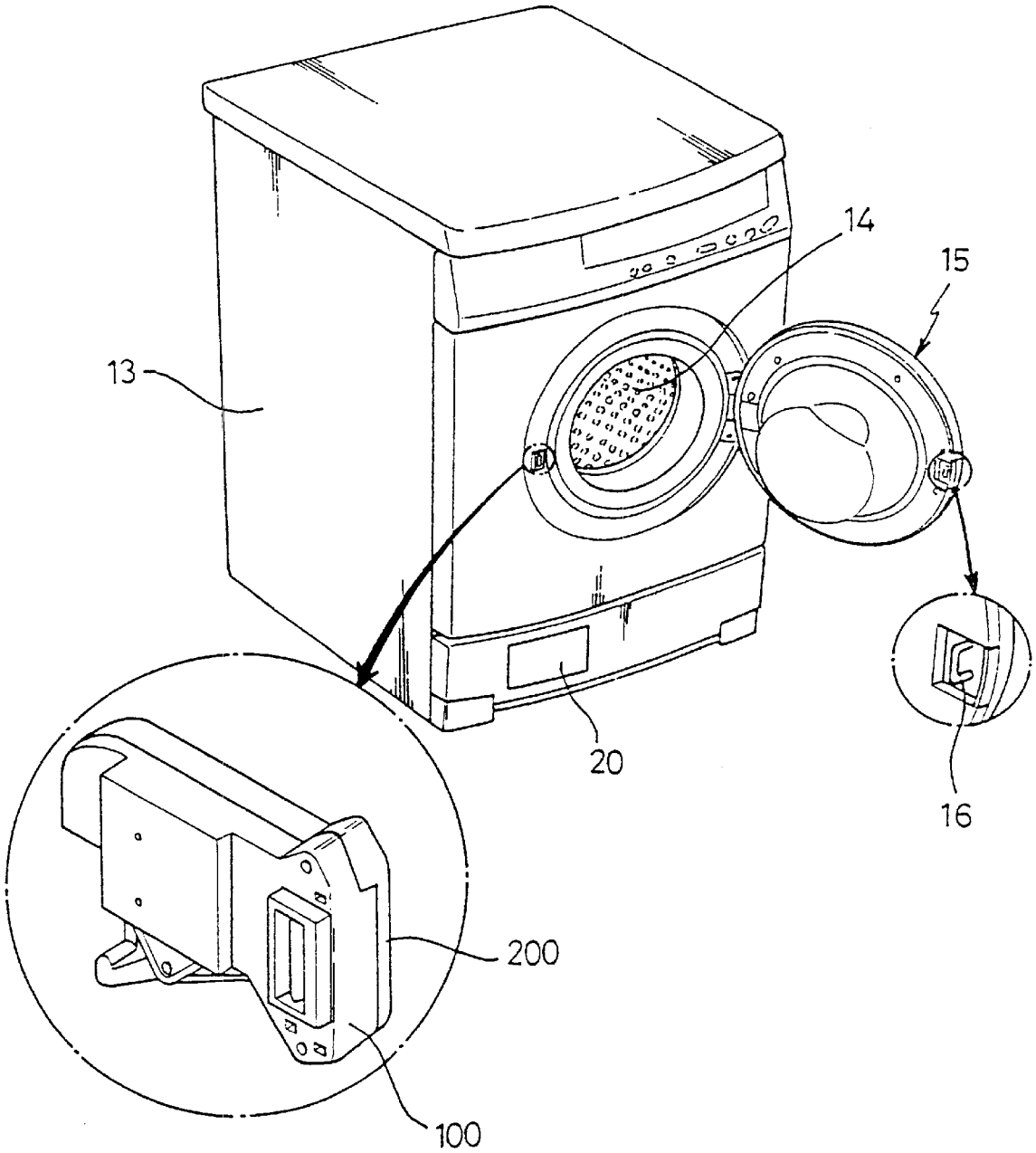
FIG.1 Related Art
FIG. 1 is a perspective view showing an appearance of a general drum type washing machine and related art door lock assembly.
Figure 2A:
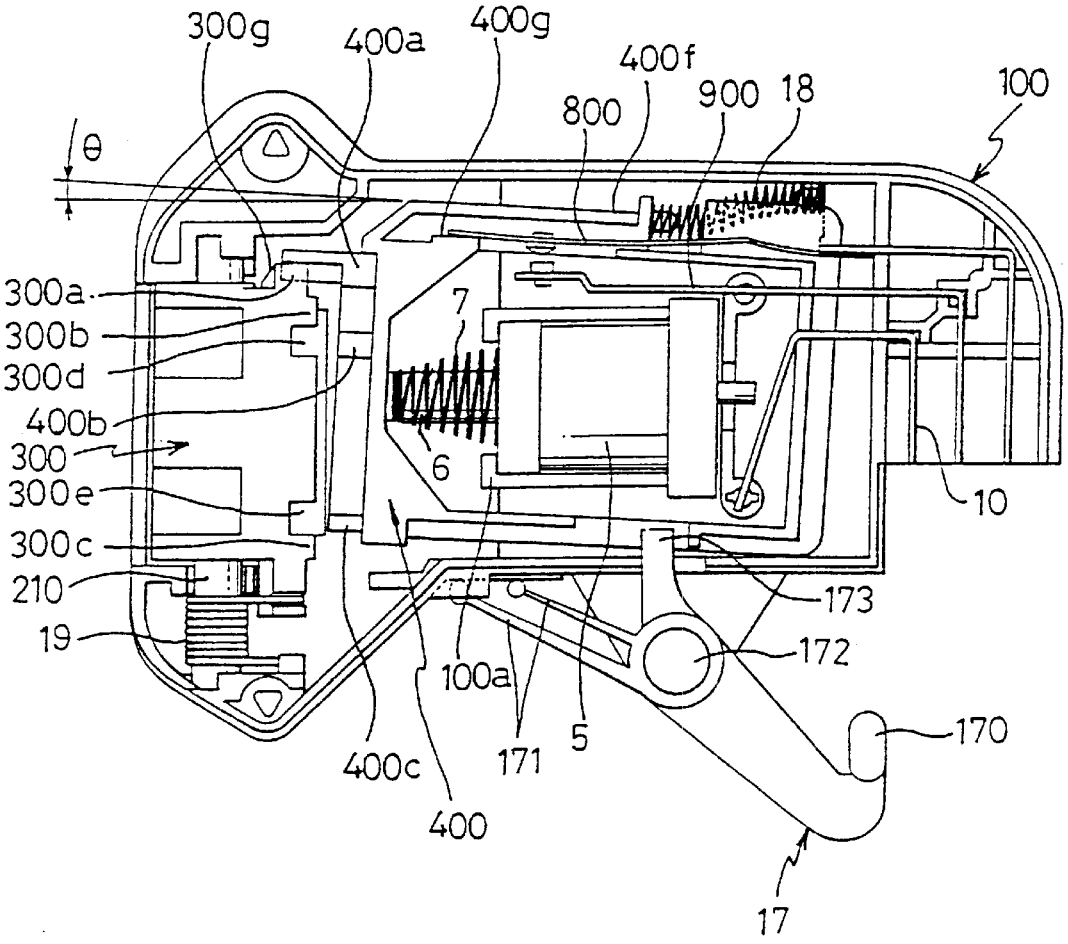
FIG.2A Related Art
FIGS. 2*a* and 2*b* are rear views showing an inner structure of the related art door lock switch assembly of FIG. 1 and an inner structure thereof in which a rear cover is removed therefrom to show the door unlocking operation.
Figure 2B:
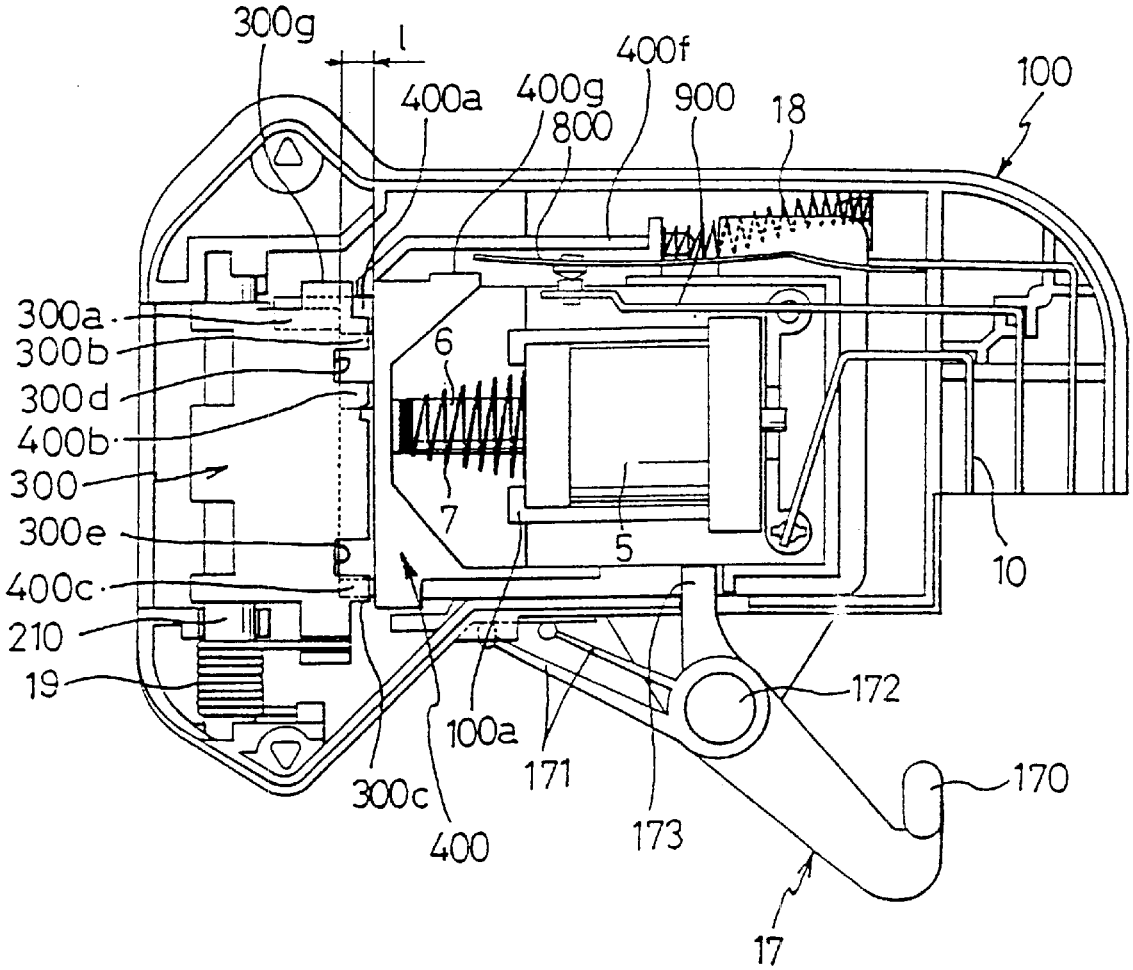
FIG.2B Related Art
Figure 3A:
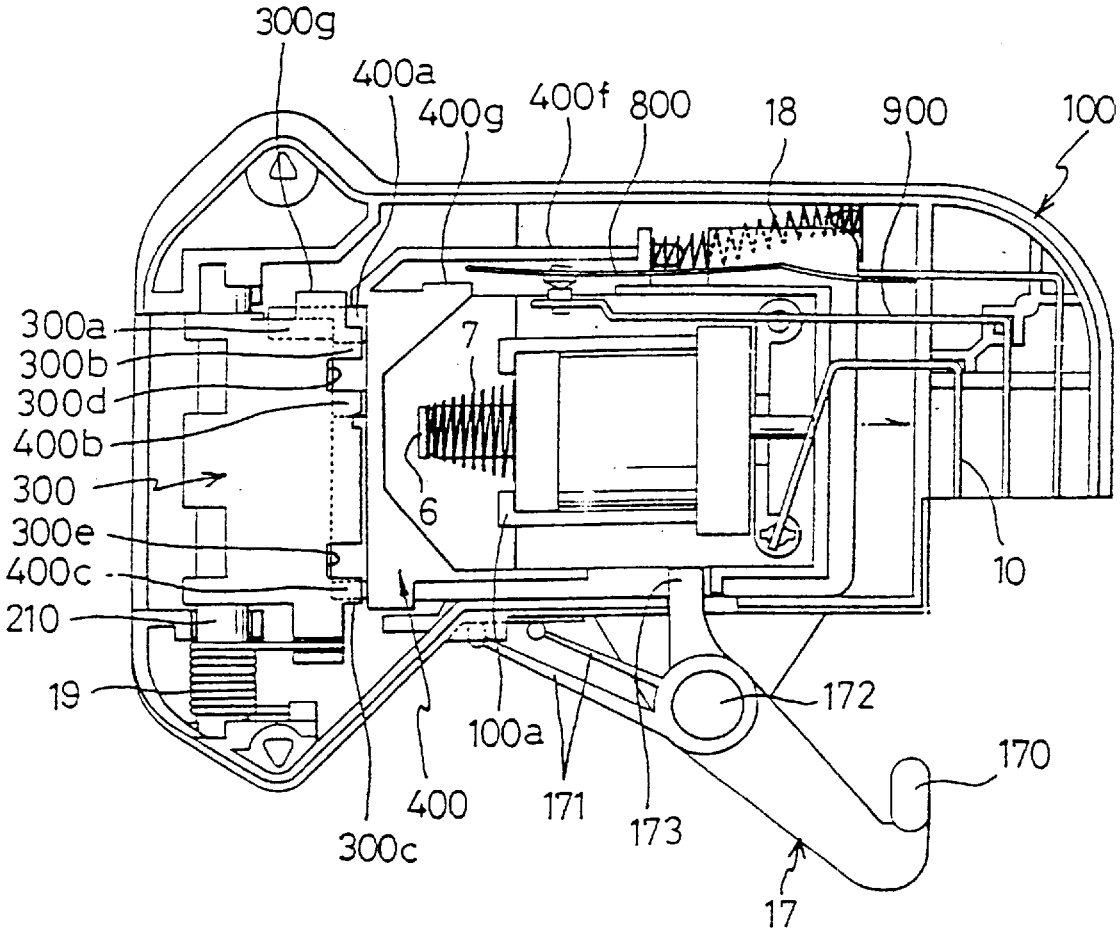
FIG.3A Related Art
Figure 3B:
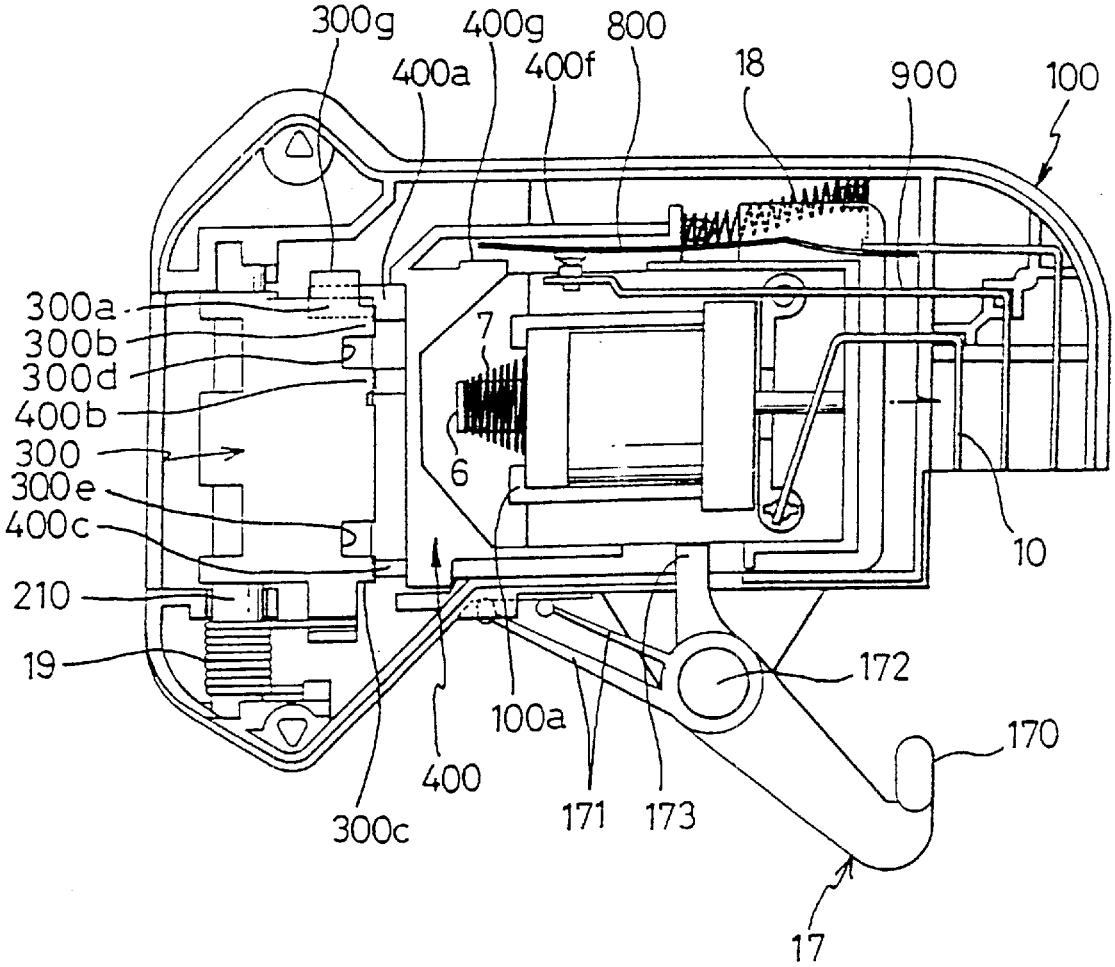
FIG.3B Related Art
Figure 3C:
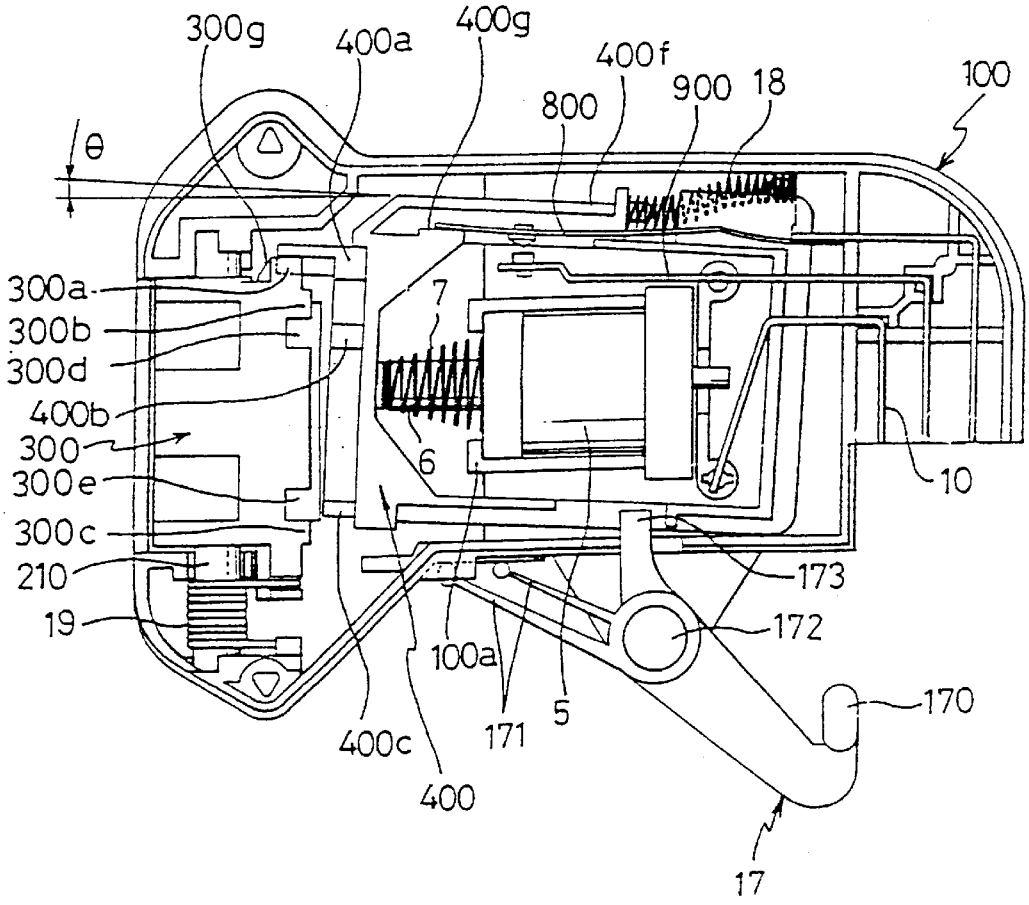
FIG.3C Related Art
Figure 4A:
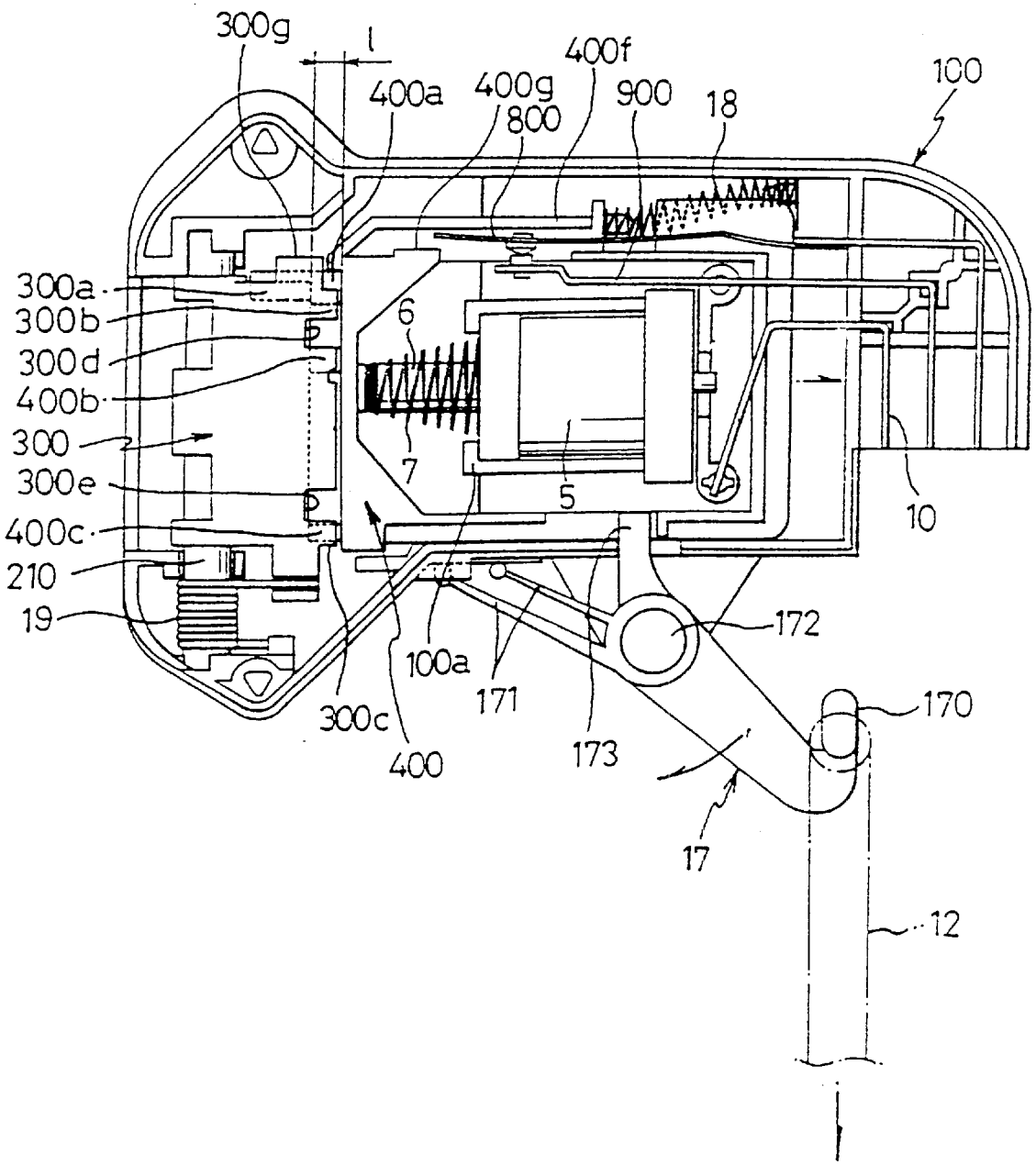
FIG. 4A Related Art
Figure 4B:
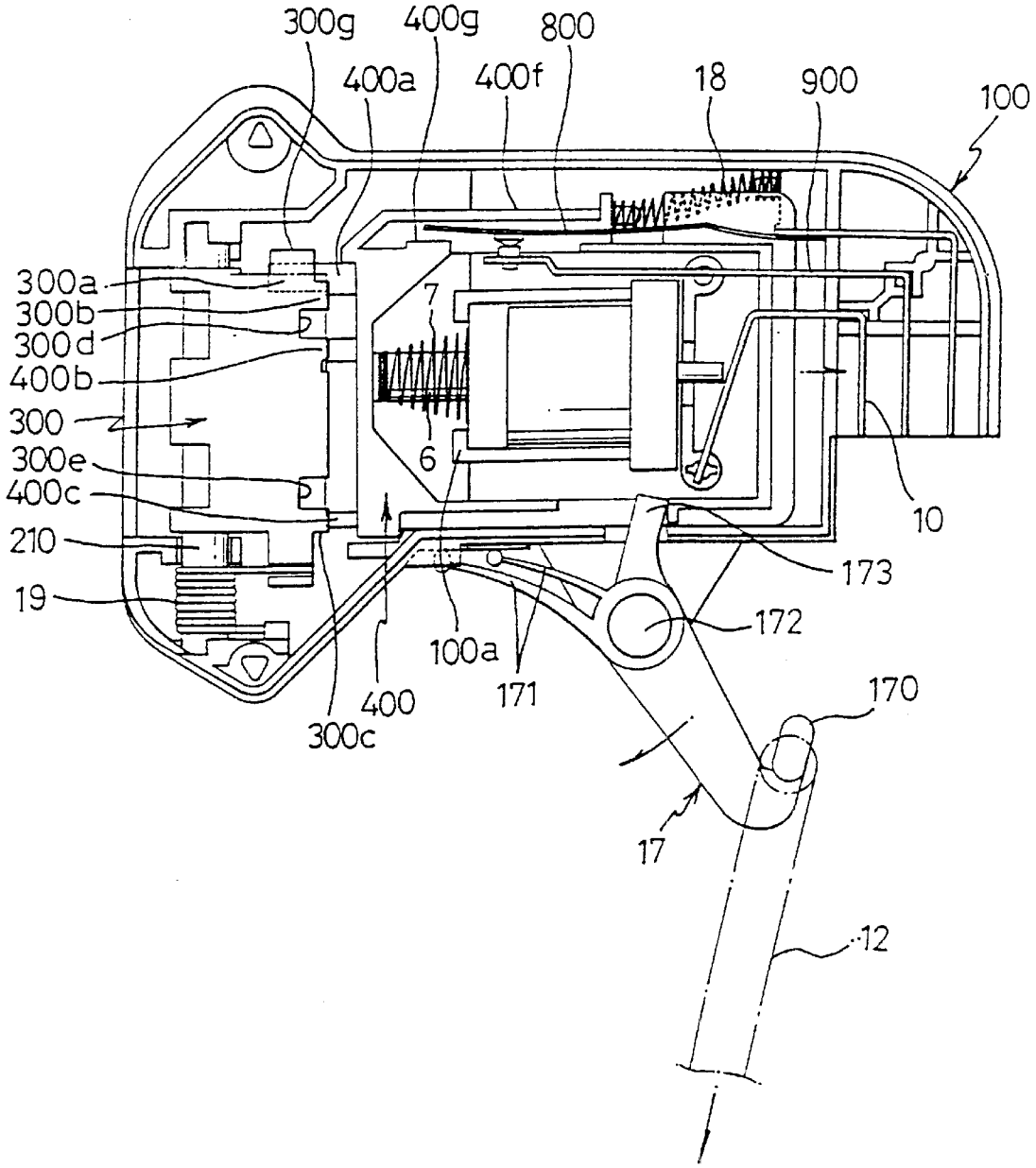
FIG. 4B Related Art
Figure 4C:
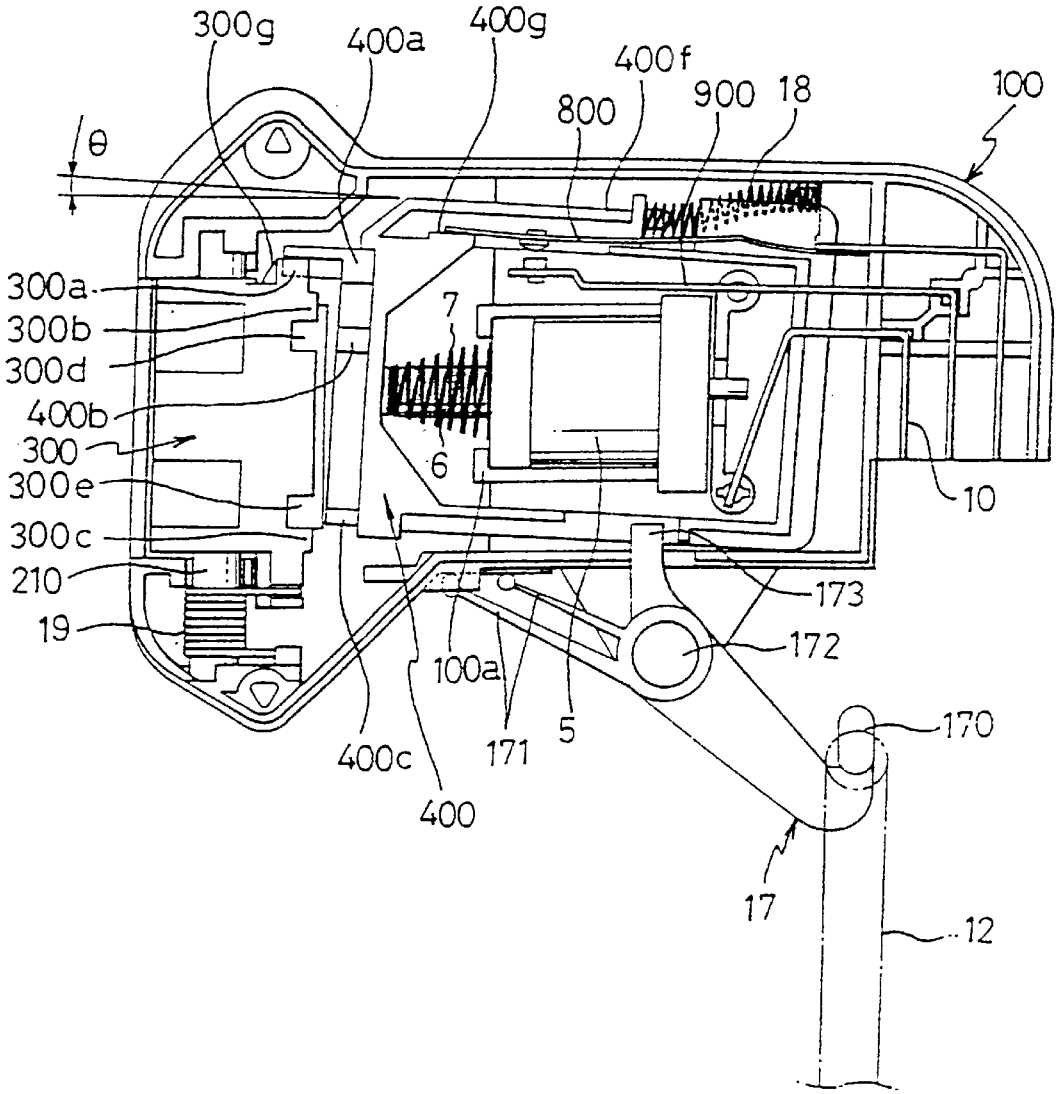
FIG. 4C Related Art
Figure 5:
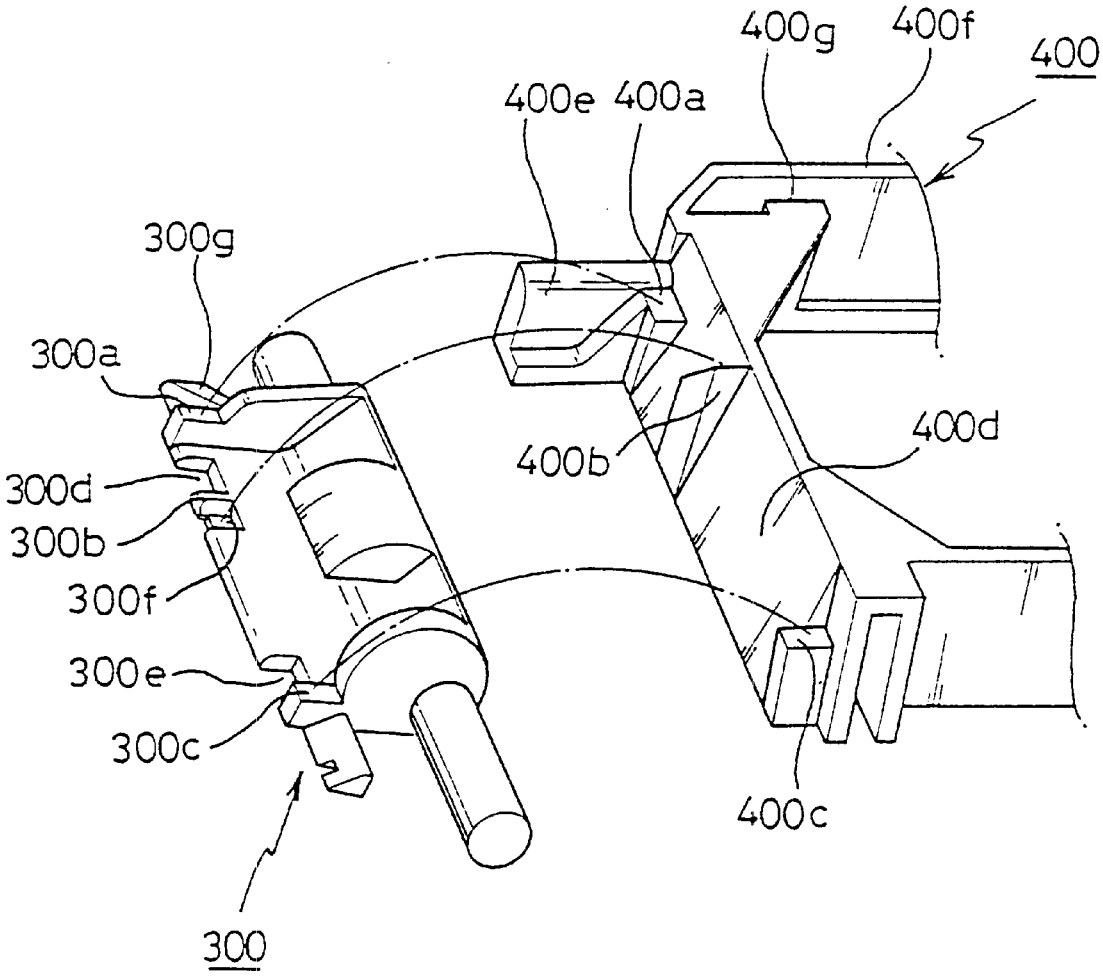
FIG.5 Related Art
FIG. 5 is an exploded perspective view showing connection relationship between a latch holder and a slide in the related art door lock switch assembly.
Figure 6:
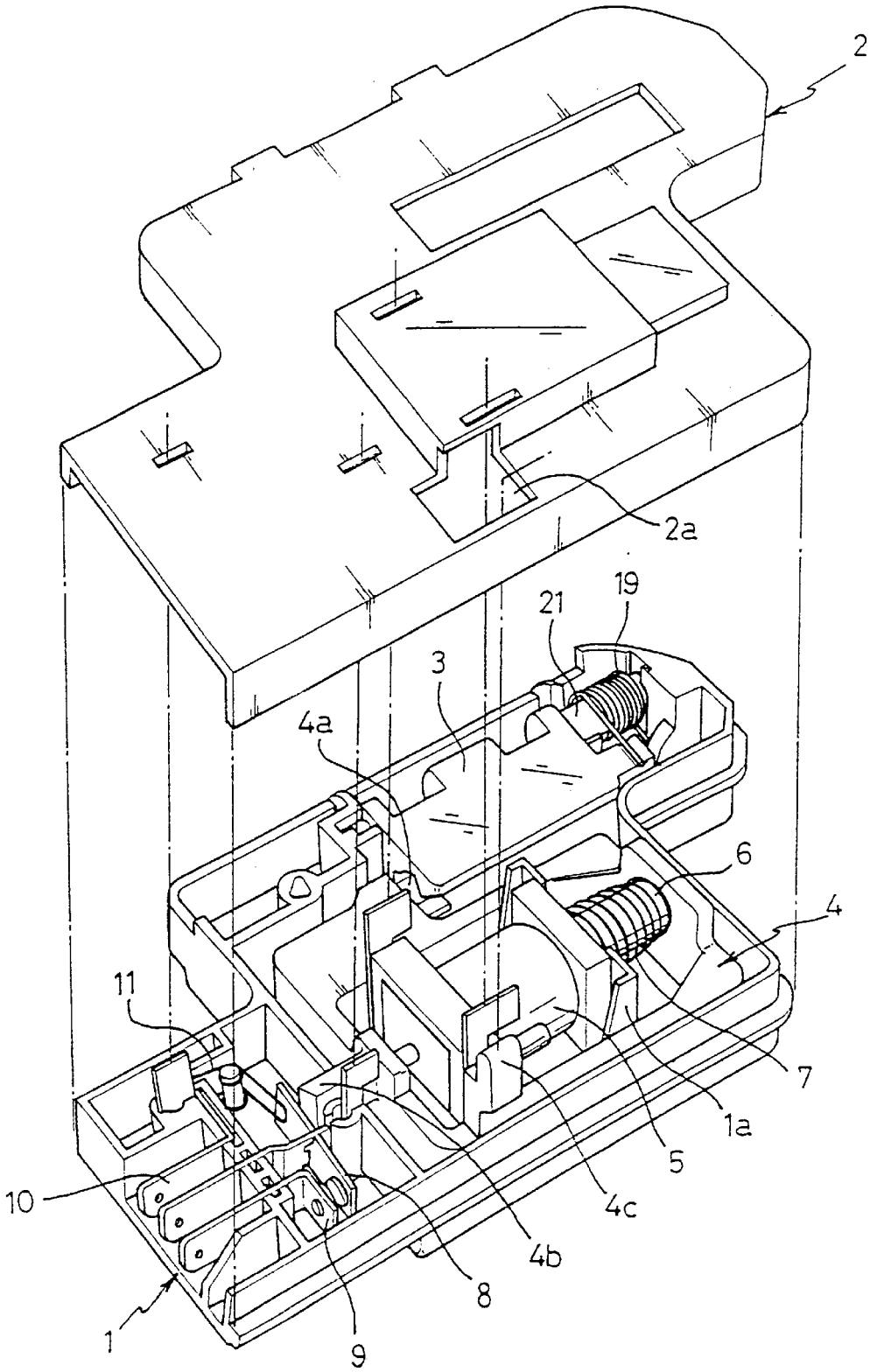
FIG. 6 is an exploded perspective view showing a structure of a door lock switch assembly according to the present invention.

Reference will now be made in detail to the preferred embodiments of the present invention, examples of which are illustrated in the accompanying drawings. A door lock switch assembly in a drum type washing machine according to the present invention will be described with reference to FIG. 6 to FIG. 11.

The door lock switch assembly of the present invention includes a switch case 1, a switch cover 2 fitted to the switch case 1, a latch holder 3 elastically and rotatably fitted to one side portion of the switch case 1 for having restoring force in a door unlocking direction, a slide 4 on one side of the latch holder 3 in the switch case 1 to be movable in a direction the same with the hinge shaft in up and down direction for arresting or releasing the latch holder 3, a solenoid assembly fitted to a central portion of the switch case 1 for moving the slide 4 in the up and down directions, and a switching part located below the slide 4 for making switching by a seesaw action of switching terminals following the up and down movements of the slide 4.

The latch holder 3 has a hook 3*a* formed at one side thereof for hooking a latch 16 at a front end of the door in a door locking, and a notch portion 3*b* with a V-notch 3*c* at a low portion of the latch holder 3. There is a stopper 4*a* formed at one side of the slide 4, which makes a close contact to the bottom of the latch holder 3 when the door lock is released, and is fitted into the V-notch 3*c* in the lower portion of the latch holder 3 when an interference to the latch holder 3 is freed as the latch holder 3 rotates greater than a certain angle by the latch 16 in the door locking, for stopping any further movement of the latch holder 3, thereby preventing the latch holder from returning to the door opened position. To minimize a friction between the stopper 4*a* and the V-notch 3*c* when the slide 4 move down in releasing the latch holder 3, and to maintain a positive stop of the latch holder 3 by the stopper 4*a* in the door locking, the stopper 4*a* has an inversed V shape and the V-notch 3*c* has a V shape having an angle greater than the stopper 4*a*.

Meanwhile, the switching part includes a movable contact 8 provided below the slide 4 in the switch case 1 to make a seesaw action, a fixed contact 9 provided on one side of the movable contact 8 parallel with the movable contact 8, having a fixed contact point corresponding to a moving contact point on the movable contact 8, a power supply terminal 10 provided on the other side of the movable contact 8 opposite to the fixed contact 9, for supplying the power to the solenoid assembly, and a torsion spring 11 provided in one side portion of the switch case, for providing a rotative force to the movable contact 8 to bring both of contact points of the movable contact 8 and the fixed contact 9 into contact with each other in the door locking. In this instance, instead of the torsion spring 1, a compression spring or a tension spring may be provided.

Meanwhile, there is a common contact terminal 8*a* in a lower portion of the switch case 1 to support seesaw movement of the movable contact 8. The common terminal 8*a* has a supporting portion 8*a*-1 for supporting the movable contact 8 inside of the top end thereof, a projection 8*a*-5 outside of the supporting portion 8*a*-1 for preventing the movable contact 8 from being detached from the common terminal 8*a*, a bent portion 8*a*-4 and a recess 420*b* provided in the center along the length direction of the common terminal 8*a* to latch the common terminal 8*a* in a baffle formed inside the switch case 1 so that the common terminal 8*a* cannot fall down from the switch case 1. There is a wire connecting portion 8*a*-3 provided at one side of the top end of the common terminal 8*a*. The wire connecting portion 8*a*-3 extends to forward of the plunger 6 and is exposed to the outside of the switch cover 2. There is a projection 801 formed in the edge at the center of the movable contact 8 to prevent the movable contact 8 from being detached from the common contact 8*a* toward its length direction and to restrict a rotative angle of the movable contact 8. There is a switch pushing piece 4*b* provided on a lower part of the slide 4 in flush with the plunger 6 to push the movable contact 8 of the switching part when the slide 4 moves down. As a result, the contact points of the movable contact 8 and the fixed contact 9 are opened so that the contact points come away from each other. At this time, the bottom face of the switch pushing piece 4*b* has a slope side to substantially conform to an angle of the movable contact 8 slanted in horizontal direction when unlocking the door.

The solenoid assembly includes a solenoid 5 fitted into a fastening part 1*a* formed in the central portion of the switch case 1, having a power supplying terminal exposed through the switch cover 2, a plunger 6 for being drawn into the solenoid 5 when the solenoid 5 is turned on, for moving the slide 4 backward, and a compression spring 7 provided on the outer circumferential surface of the plunger 6 to move the plunger 6 forward. There is a manual unlocking knob 4*c* formed at one side of the slide 4 as a unit with the strap 12 to pull the slide 4 down in a manual release of the door locking. The manual unlocking knob 4*c* is projected to the outside of the switch cover 2 through a through hole 2*a* in the switch cover 2.

The operation of the aforementioned door lock switch assembly in accordance with a preferred embodiment of the present invention will be described. First, the operation of door locking from a door opened state by closing the door will be described.

Figure 7A:
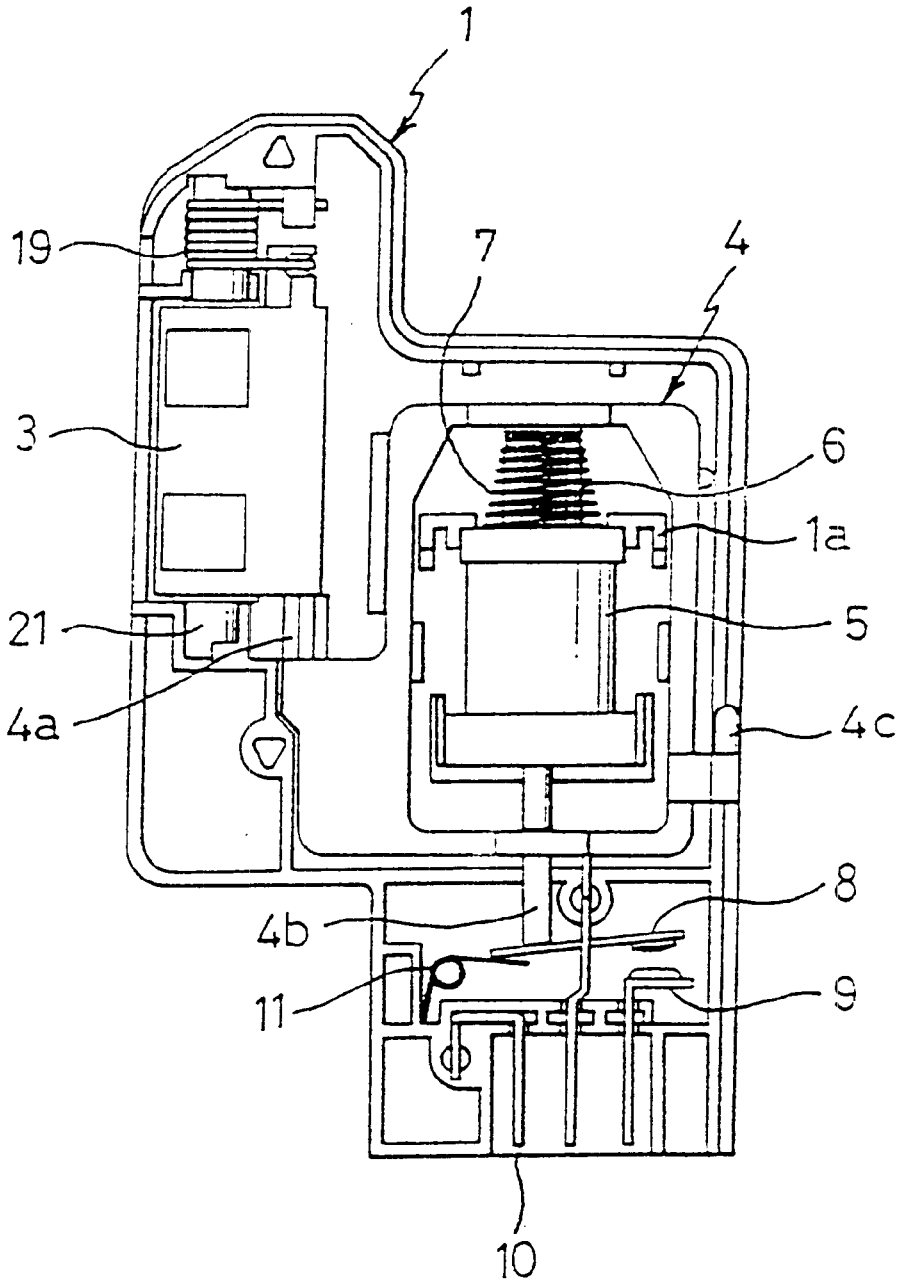

Referring to FIG. 7*a,* in the door opened state, the top end of the stopper 4*a* on the slide 4 has a close contact with the bottom of the latch holder 3 blocking the slide 4 from moving upward any more, when the contact points in the switching part are opened, and kept a turned off state. Under this door opened state, when the door 15 is rotated around the hinge shaft to close the door 15, the latch 16 at the front end of the door pushes the latch holder 3 to rotate the latch holder 3 while the latch holder 3 deforms the torsion spring 19 elastically, until the interference between the bottom of the latch holder 3 and the top of the stopper 4*a* on the slide 4 is freed, when the plunger 6 in the solenoid assembly moves upward by the compression spring 7 disposed around the plunger 6, and the slide 4 advances along an axis of the latch holder 3 by the plunger 6 to a position opposite to the hook 3*a* on the latch holder 3, that impedes returning of the latch holder. In this instance, the V stopper 4*a* on the slide 4 is located in the V-notch 3*c* in the notch portion 3*b* in a lower portion of the latch holder 3.

In the meantime, in the foregoing door locking, i.e., when the slide 4 moves upward by the rising plunger 6, the contacts kept spaced away come into contact by the switch pushing piece 4*b* under the slide 4. In other words, the rotation of the movable contact 8 in a clockwise direction on the drawing around the hinge point by the restoring force of the torsion spring 11 in the one side portion of the switch case following the upward movement of the slide 4 results in the contact point on the movable contact 8 to come into contact with the contact point on the fixed contact 9, thereby turning on the switching part, that provides the power to the driving part, the water supply valve and the water discharge pump in the washing machine. Meanwhile, in the door locked state, even though the force pushing the latch holder 3 is eliminated, as reversal of the latch holder 3 is prevented, the latch 16 can not be freed from the hook 3*a* on the latch holder 3. And, as the latch holder 3 is latched in the stopper 4*a* of the slide 4, preventing the latch holder 3 from returning to a position at the time of the door open, the latch 16 on the door 15 cannot also escape from the hook 3*a* of the latch holder 3, that achieves the locking of the door.

The operation for unlocking the door from the door locked state will be described with 5 reference to FIG. 7*b* and FIGS. 8*a* to 8*c*.

Figure 7B:
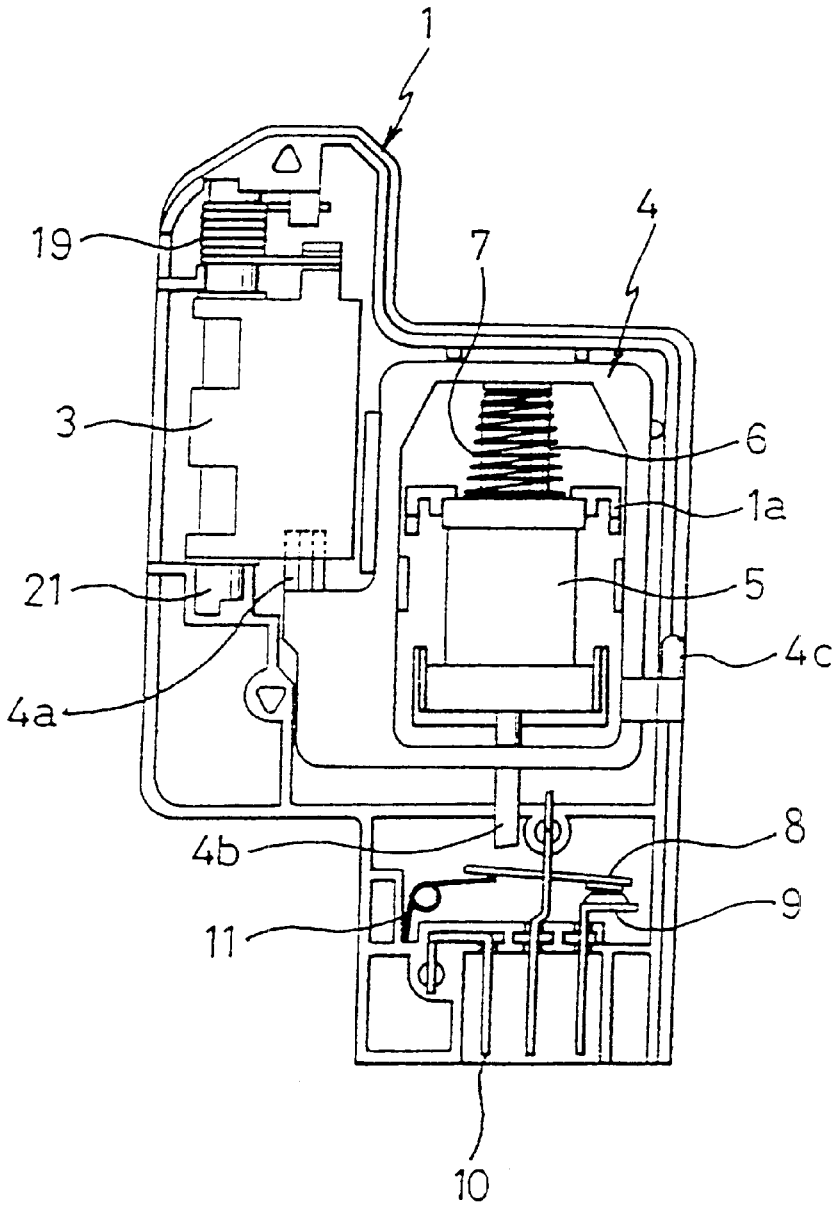
Figure 8A:
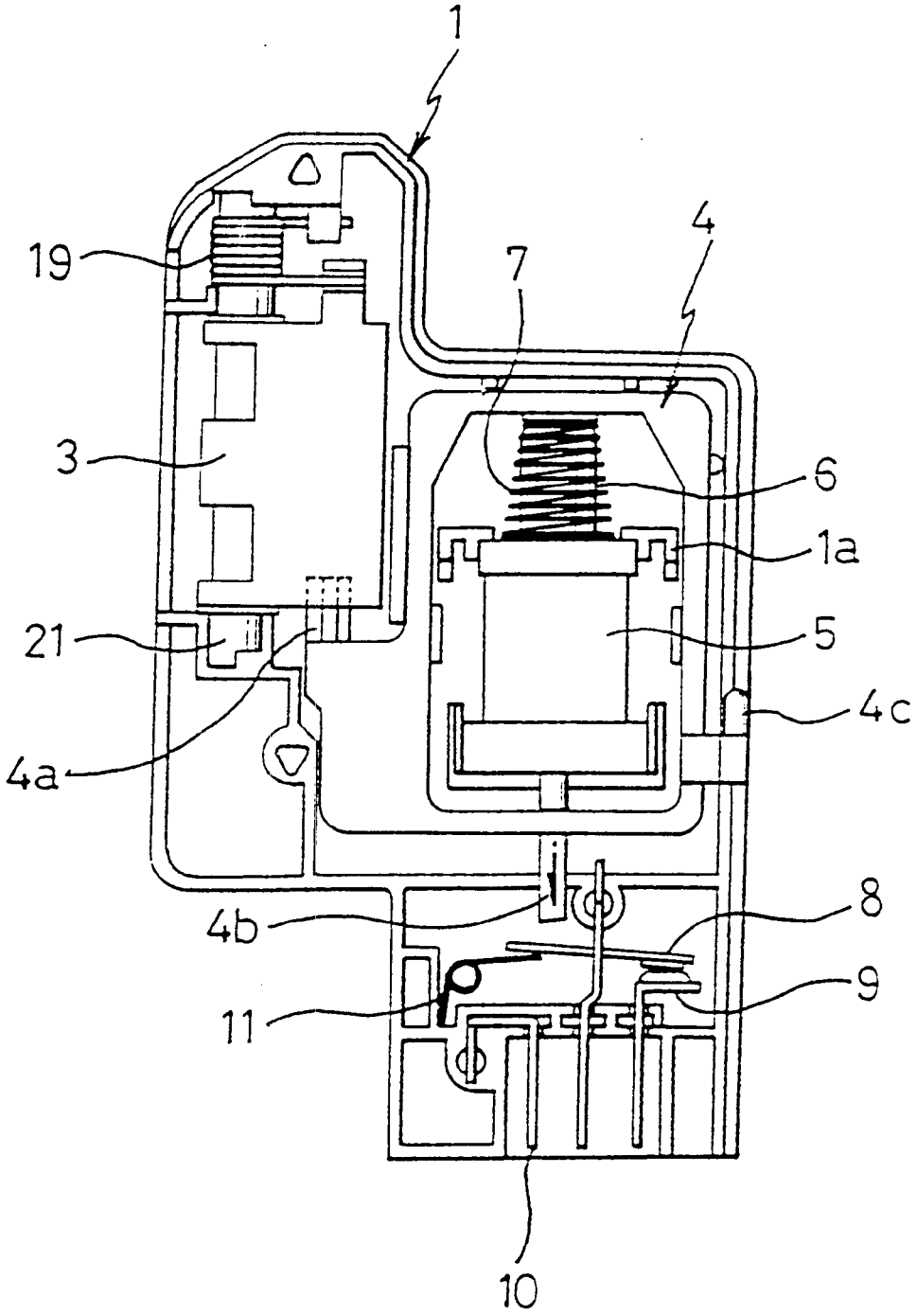
Figure 8B:
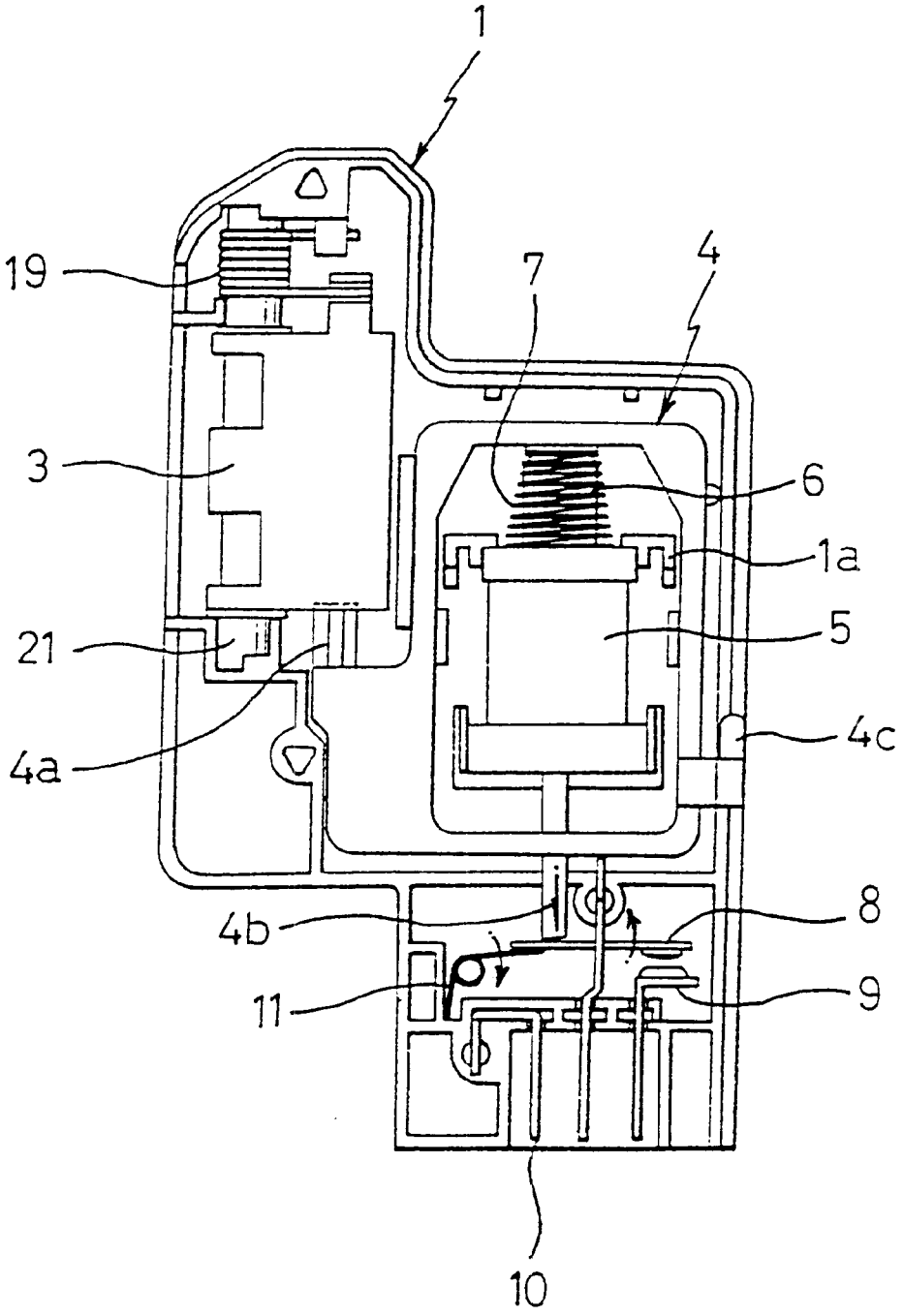
Figure 8C:
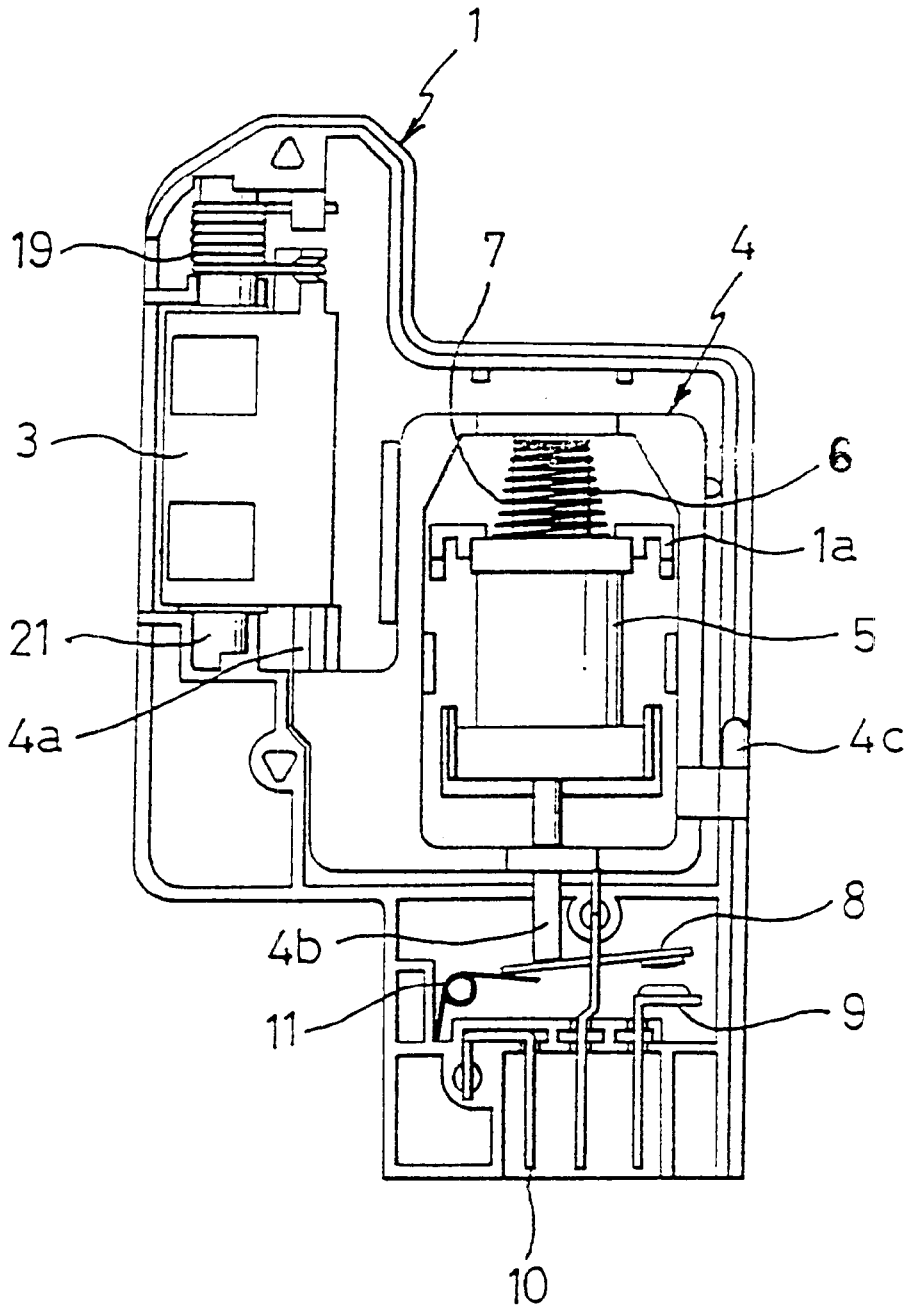

Referring to FIG. 7*b,* in the door locked state, when the user pushes a door lock release button(not shown) to supply the power to the solenoid 5, the plunger 6 moves down along the axis of the latch holder 3 while the plunger 6 compresses the compression spring 7 as the solenoid 5 draws in the plunger 6. In this instance, the plunger 6, moving downward, pushes the slide 4 downward from the moment the plunger 6 comes into contact with the lower sidewall of the slide 4 as shown in FIG. 8*a* until the stopper 4*a* on the slide 4 positioned in the V-notch 3*c* in the bottom portion of the latch holder 3 in a direction of the hinge shaft 21 of the latch holder 3 escapes from the bottom portion of the latch holder 3 fully. In other words, when the slide 4 moves down by the solenoid 5 to pass through states of FIGS. 8*a* and 8*b* until the stopper 4*a* on the slide 4 escape from the bottom portion of the latch holder 3 completely, the latch holder 3 returns to a state of FIG. 8*c,* the door unlocked state, by the torsion spring 11. In short, the slide 4 moves down together with the plunger 6 by a pushing force of the plunger 6 when the plunger 6 moves down as the solenoid assembly is put into operation, until the interference between the slide 4 and the latch holder 3 is completely freed, when the latch holder 3 returns to a position where the door can be opened. In the foregoing the door locking release, the switch pushing piece 4*b* on the bottom of the slide 4 pushes an opposite side of the contact point of the movable contact 8, that leads the contact points between the fixed contact 9 and the movable contact 8 to open, when the torsion spring 11 accumulates the restoring force. Meanwhile, if the latch holder 3 rotates to return to the door opened state, the latch 16 latched in the hook 3*a* on the latch holder escapes from the latch holder 3, in which the contact points between the fixed contact 9 and the movable contact 9 are opened, cutting off the power supplied to the driving part, the water supply valve, and the water discharge pump in the washing machine.

Figure 9A:
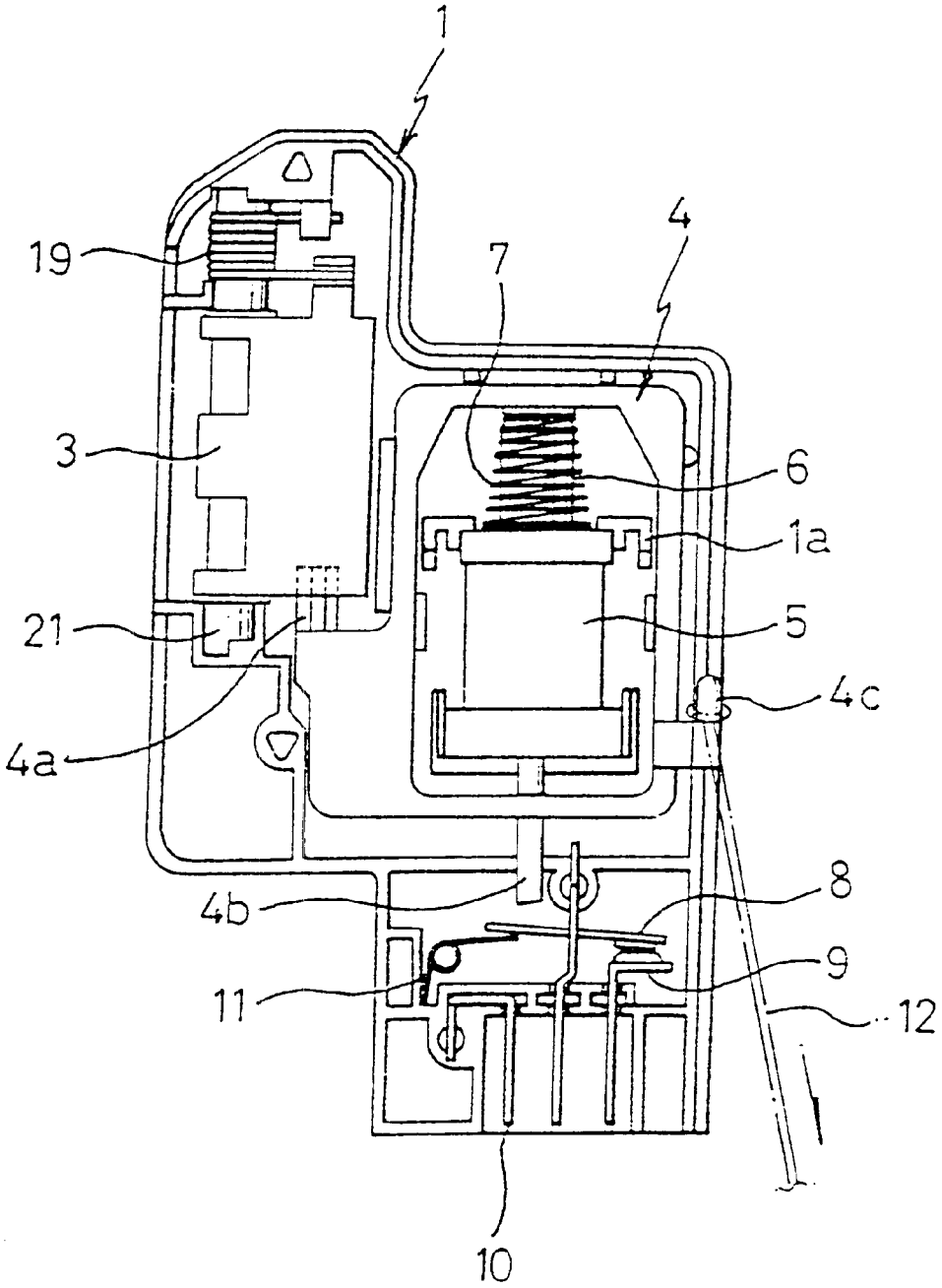
Figure 9B:
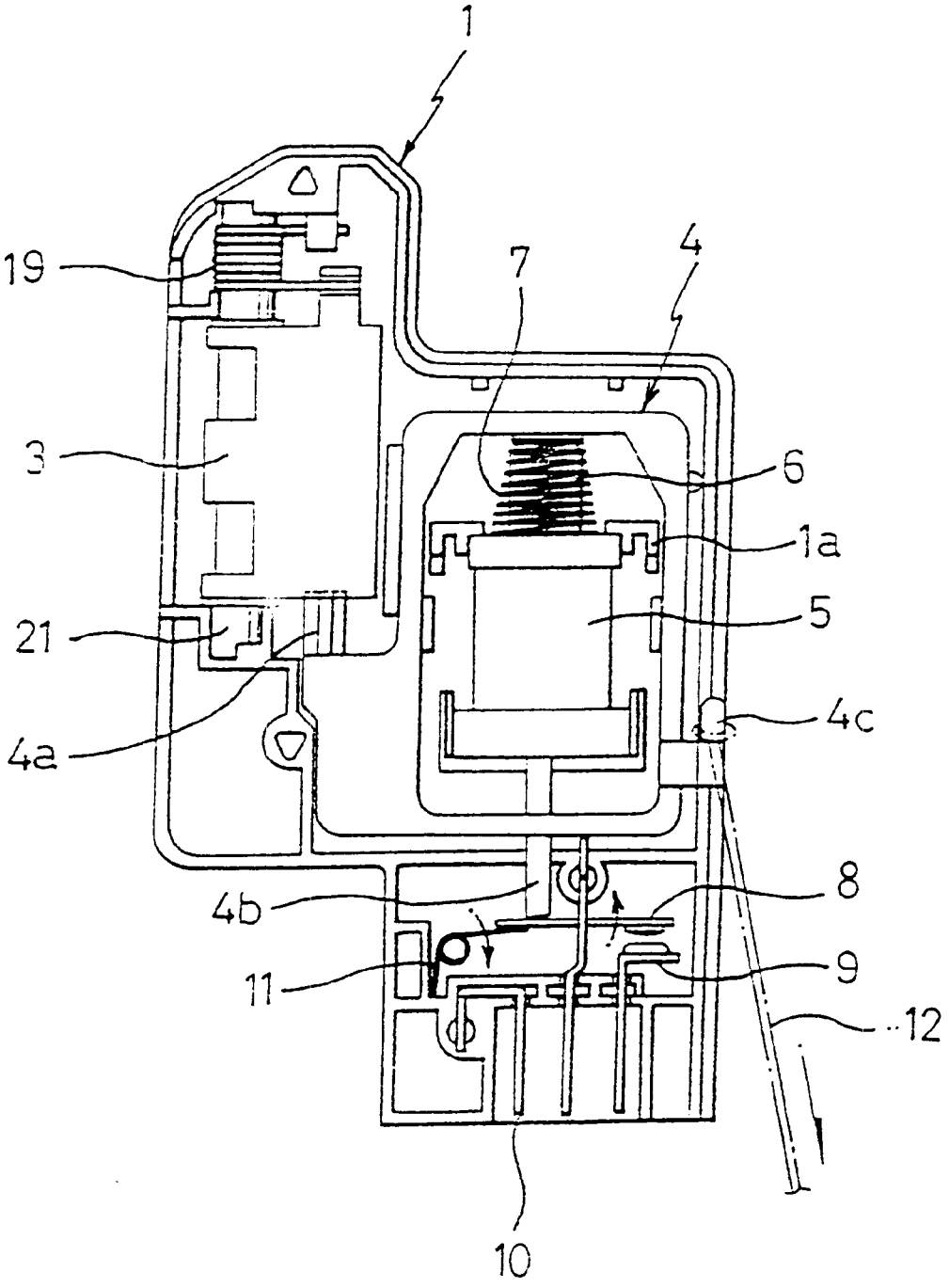
Figure 9C:
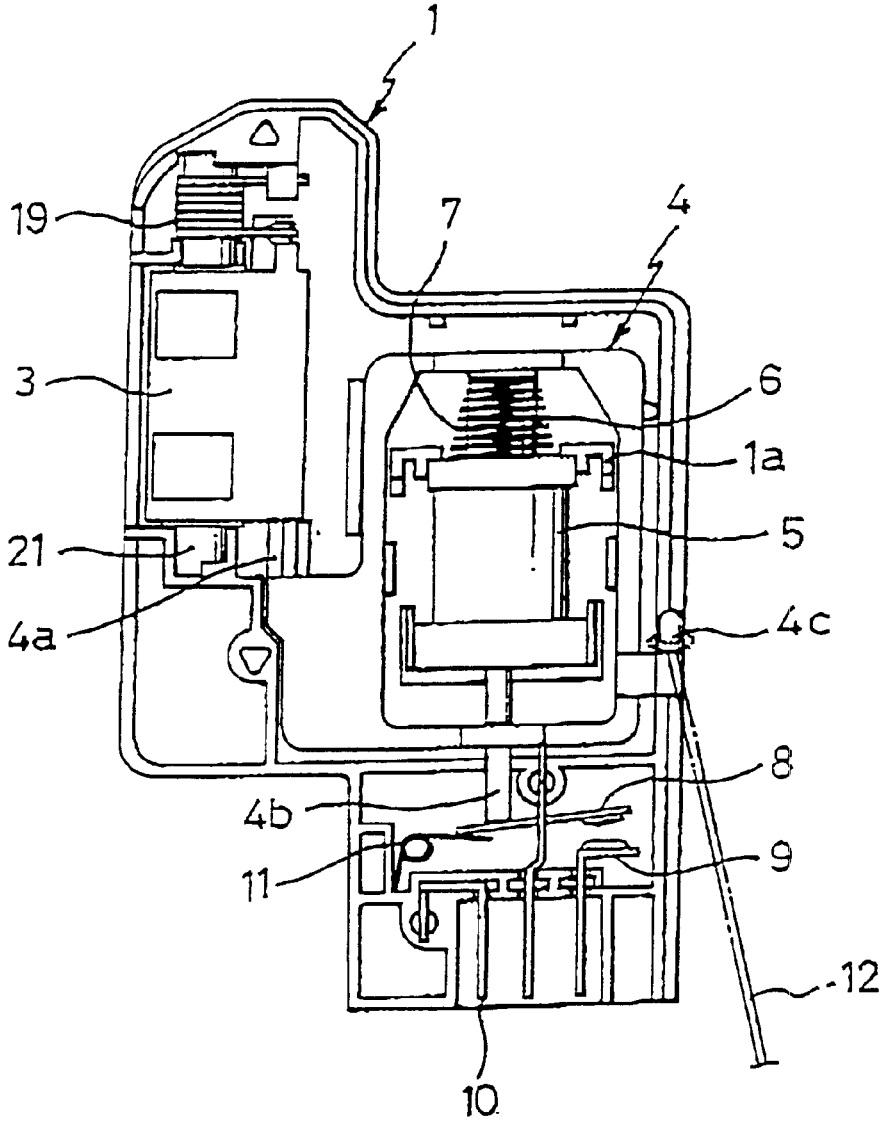
Figure 10:
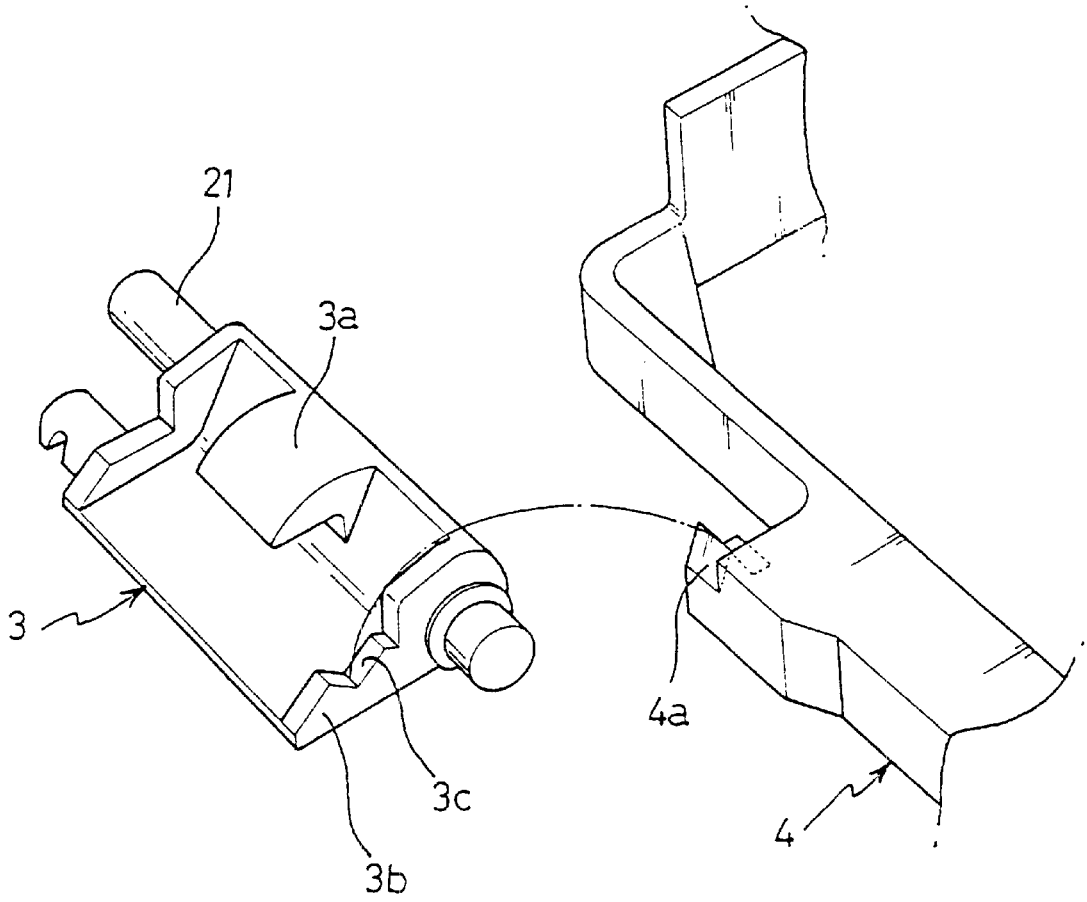
FIG. 10 is an exploded perspective view showing connection relationship between a latch holder and a slide in a door lock switch assembly according to the present invention.
Figure 11:
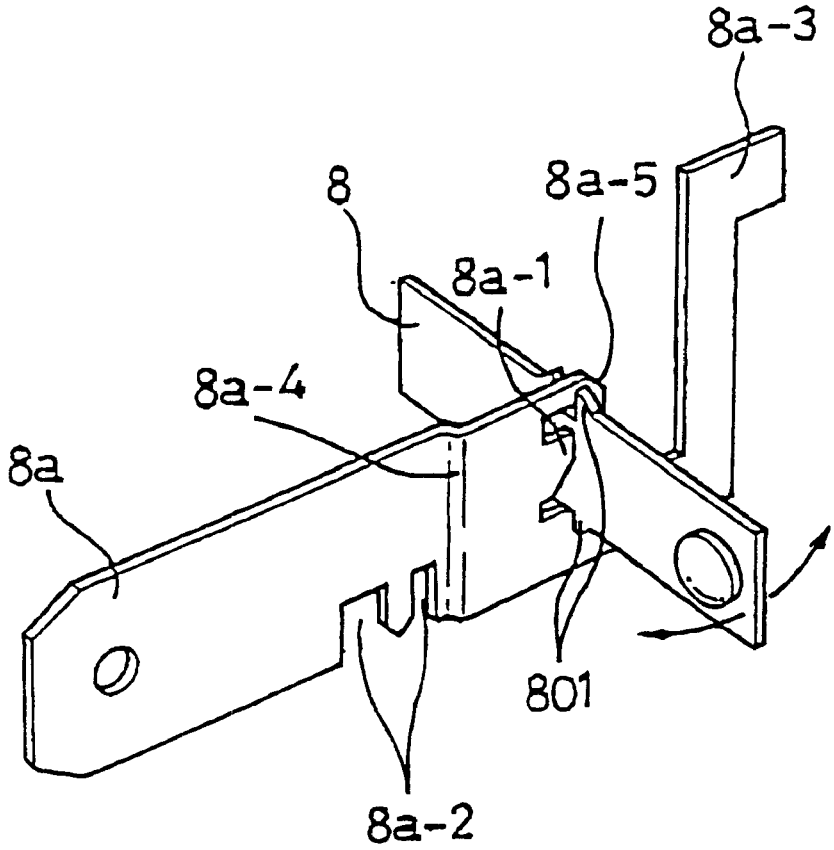
FIG. 11 is an exploded perspective view showing a seesaw structure of a switching part in a door lock switch assembly according to the present invention.

The operation for manual unlocking of the door will be described with reference to FIGS. 9*a* to 9*c*.

When the power supply to the washing machine is failed due to power failure or an out of order of the washing machine in the door locked state, the cover 20 is opened, and the strap 12 inside the cover 20 is pulled to operate the door lock switch assembly manually, for unlocking the door. In other words, as shown in FIG. 9*a*, as the user pulls the strap 12 in the door locked state, the knob 4*c* at one side of the slide 4 connected to the strap 12 is pulled directly, to facilitate an immediate moving down of the slide 4. And, upon the interference between the slide 4 and the latch holder 3 is freed, the latch holder 3 returns to the door opened position by the torsion spring 11 as shown in FIG. 9*c*, resulting in the latch 16 in the hook 3*a* of the latch holder 3 released from the latch holder 16, to release the door unlocking.

Figure 12A:
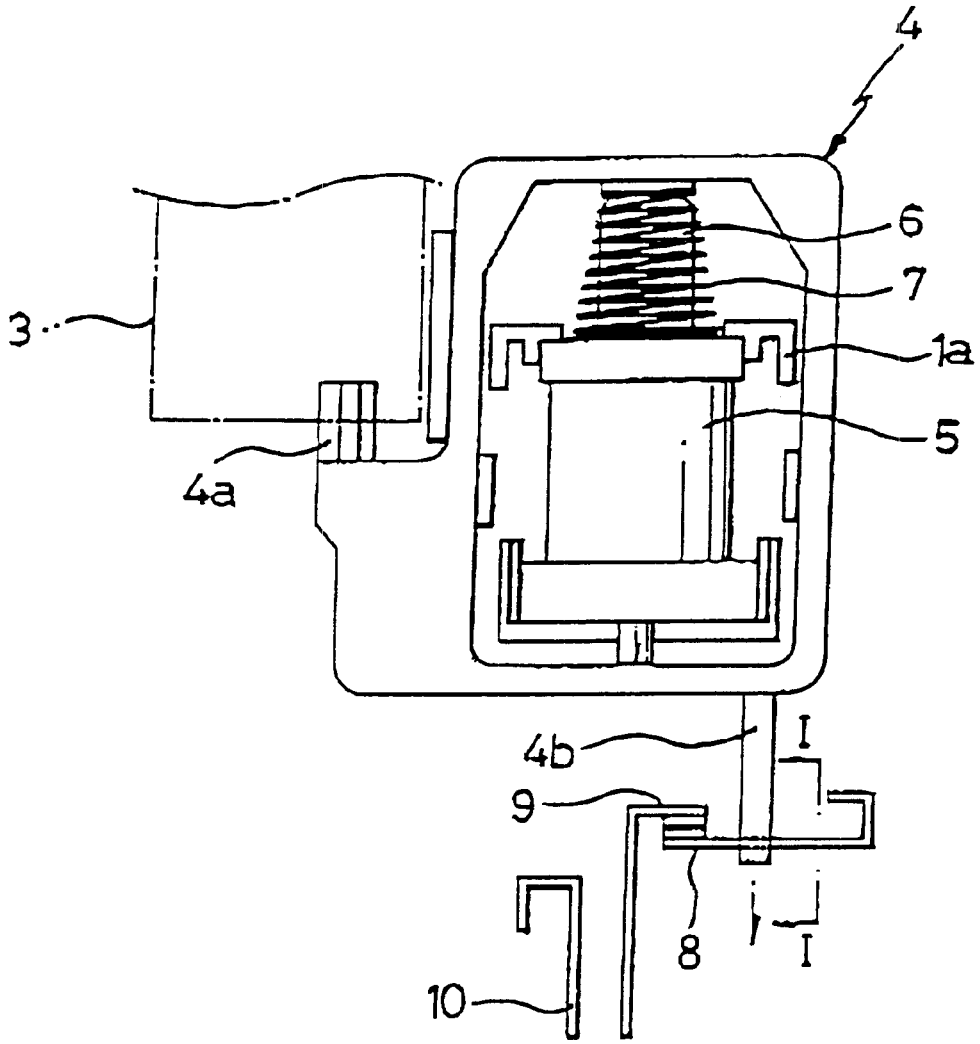
Figure 12B:
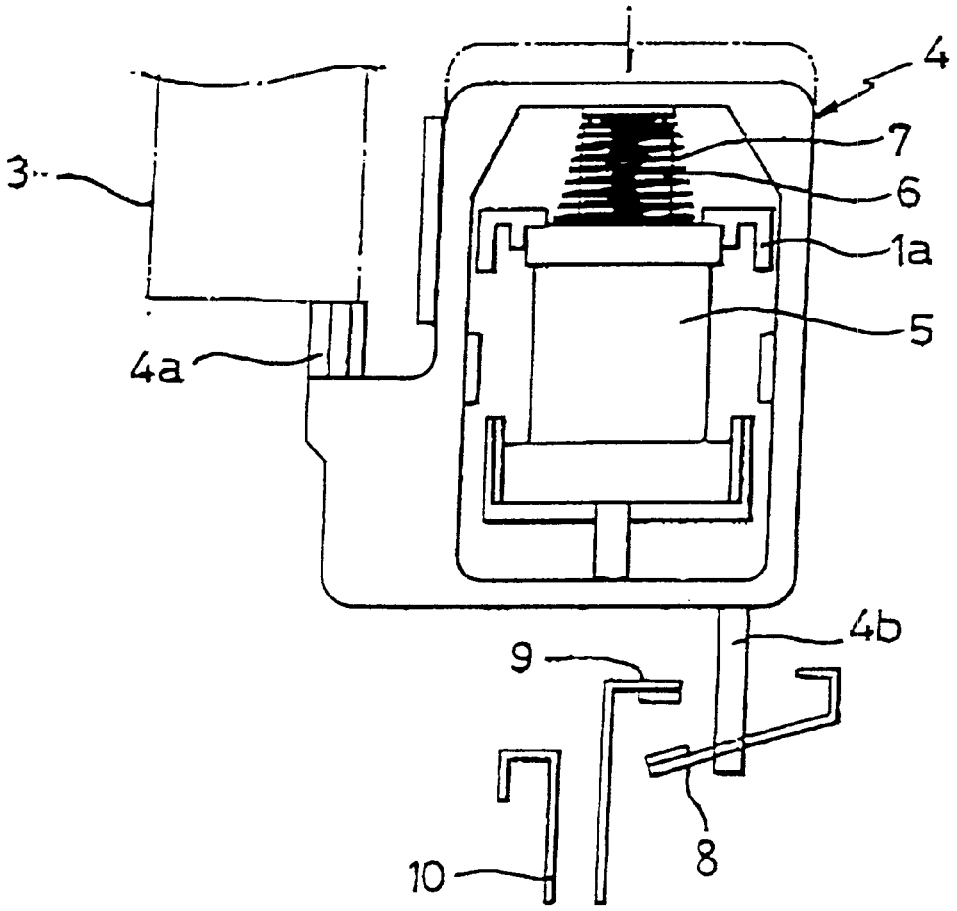
Figure 13:
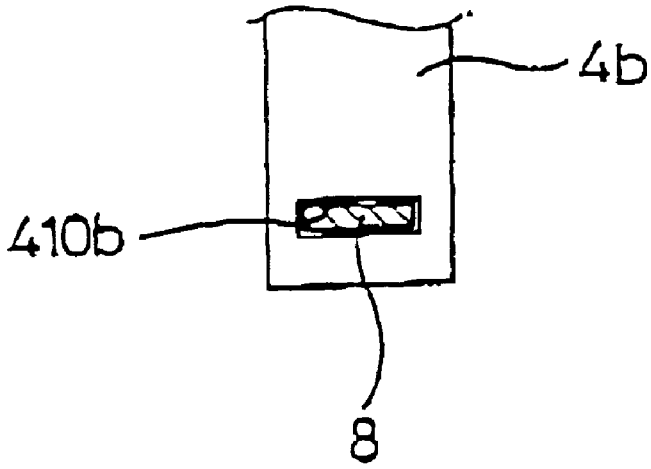

FIGS. 12*a* and 12*b* show structures of another switching part in a door lock switch assembly according to the present invention, in which FIG. 12*a* shows a contact point when a door is locked and FIG. 12*b* shows a contact point when a door is unlocked, and FIG. 13 is a sectional view showing connection state of a switch pushing piece and a movable contact, taken along line I—I of FIG. 12*a*. A switching part of the door lock switch assembly according to another embodiment of the present invention will be described FIGS. 12*a* and 12*b*. and FIG. 13.

In this embodiment, unlike the aforementioned embodiment, the closing/opening between the movable contact and the fixed contact are made by using, not a separate elastic member, such as the torsion spring, but an elasticity of the movable contact. That is, the switching part includes a movable contact 8 having a pad at a fore end, provided on one side below the slide 4 to rotate around a hinge point by a pushing force of a switch pushing piece 4*b* disposed a distance away from the center of the slide, a fixed contact 9 provided to place a pad thereon over the pad on the movable contact 8 so that the contact points are opened when the switch pushing piece moves down, and a power supply terminal 10 provided at an opposite side of the movable contact 8 with reference to the fixed contact, for supplying power to the solenoid assembly.

Referring to FIG. 13, the movable contact 8 is provided to pass through the through hole 410*b* in a fore end of the switch pushing piece 4*b* under the slide 4 at one side thereof, for providing the movement of the slide 4 directly to the movable contact 8 when the slide 4 moves. Also, the movable contact 8 has a free end at its top face and a fixing end fixed to the switch case 1.

The operation of the aforementioned switching part will be described.

Referring to FIG. 12*a* showing the door locked state, since the switch pushing piece 4*b* on the slide does not push the movable contact 8 in this state, the contact points on the movable contact 8 and the fixed contact 9 maintain contact with each other, providing the power to the driving part, the water supply valve and the water discharge pump in the washing machine. Under this state, if the slide 4 moves down by the door lock release operation of the solenoid assembly or by the manual door lock release operation, the switch pushing piece 4*b* on the slide pushes a top surface of the movable contact 8, which leads to rotation of the movable contact 8, that moves the pad on the movable contact 8 away from the pad on the fixed contact 9. Thus, when the slide 4 moves up and down, the movable contact 8, passed through the through hole 410*b* on the switch pushing piece 4*b,* rotates centered on the hinge point to make a positive switching action as the movable contact 8 is designed to receive the movement of the slide, directly.

Figure 14:
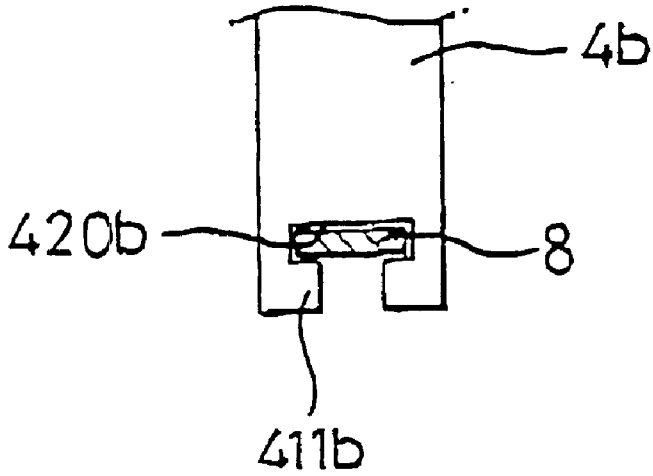
* and FIG. 14 is a sectional view showing another connection state of a switch pushing piece and a movable contact, taken along line I—I of FIG. 12*a*.

Meanwhile, FIG. 14 is a sectional view showing another embodiment of FIG. 13.

In this case, instead of the through hole 410*b* in the switch pushing piece 4*b* on the slide 4, a through hole 420*b* with a hanging portion 411*b* for preventing the movable contact 8 from being fallen away may be formed at the front end of the switch pushing piece 4*b* to place the movable contact 8 in the through hole 420*b,* for transmitting the movement of the slide 4 to the movable contact 8. In order to facilitate a structure in which the movement of the slide 4 is transmitted to the slide 4 directly, the slide is required to be formed of an insulating material, such as plastic. In a case the elasticity of the movable contact 8 itself is used, the structure of the switching part can be further simplified to reduce a number of components of the door lock switch assembly, with a consequential improvement in assembly.

The aforementioned door lock switch assembly of the present invention has the following advantages.

Though the related art latch holder 300 and the slide 400 has a complicate structure for making and releasing an interference, the latch holder and the slide of the present invention have a simple one. That is, in the related art door lock switch assembly, because the slide 400 moves back and forth sloped at a certain angle to a direction perpendicular to a direction of the hinge shaft of the latch holder 300 while the contact points are required to open/close in a direction perpendicular to the direction of movement of the slide 400, the structure becomes very complicate. That is, the related art door lock assembly is required to take lots of factors into account in design the same because the related art slide 400 is required to be disposed on a horizontal line at the moment of a door locking even if the related art slide 400 makes movement slanted to the horizontal direction, while the contact points are opened/closed by an interference between the slide 400 and the movable contact in a direction perpendicular to the horizontal direction. Consequently, the related art door lock assembly has a complicated structure, to cause much interference between the components, that makes securing a reliability difficult as much. Opposite to this, the door lock switch assembly of the present invention is a simple structure and has a good operation reliability as much since the slide 4 of the present invention has a simple liner movement. That is to say, as a direction of movement of the slide 4 of the present invention is the same with a pushing direction of the plunger 6, and the locking can be made once the latch holder 3 passes through the top of the stopper 4*a*, the door lock switch assembly of the present invention has a simple structure and an improved operation reliability in proportion to this.

In the meantime, though the related art door lock switch assembly requires a large force in manual unlocking because the pulling force on the strap 12 exerts indirectly through a rotating movement centered on the hinge shaft, the door lock switch assembly of the present invention requires a small force in manual unlocking and can transmit the pulling force positively because the pulling force on the strap 12 exerts directly to the slide 4.

And, though the related art door lock switch assembly has complicate terminal fitting positions and prolonged terminal lengths, which requires much material, the door lock switch assembly of the present invention has simple terminal fitting positions and arrangement, and minimum terminal lengths. That is, though the related art door lock switch assembly has lengthy switching terminals with bend, to require a complicate switch case structure for fixing the terminals, the door lock switch assembly has, not only short terminal lengths, but also simple case structures for fixing the terminals, particularly, the structures of the switching part can be simplified when the elasticity of the movable contact is utilized.

It will be apparent to those skilled in the art that various modifications and variations can be made in the door lock switch assembly in a drum type washing machine according to the present invention without departing from the spirit or scope of the invention. Thus, it is intended that the present invention covers the modifications and variations of the invention provided they come within the scope of the appended claims and their equivalents.

What is claimed is:

1. A door lock switch assembly in a drum type washing machine comprising:

a switch case;

a switch cover fitted to the switch case;

a latch holder rotatably, and elastically mounted in one side portion of the switch case for exerting a restoring force in a door open direction;

a slide fitted to one side of the latch holder, for moving up or down in a direction the same with a hinge shaft of the latch holder to arrest or release the latch holder;

a solenoid assembly mounted in a central portion of the switch case, for moving up or down the slide; and, a switching part located below the slide, for making a switching operation as a terminal thereof makes a seesaw action following the moving up or down of the slide.

2. The door lock switch assembly as claimed in claim 1, wherein the latch holder includes;

a hook at one side thereof for latching the latch at a fore end of the door, and a notch portion having a V-notch in a lower portion of the latch holder.

3. The door lock switch assembly as claimed in claim 1, wherein the slide includes;

a stopper at one side thereof for making a close contact to a bottom of the latch holder when the door lock is released, and fitting, into a V-notch in the lower portion of the latch holder when an interference to the latch holder is freed as the latch holder rotates greater than a certain angle by the latch in a door locking, for stopping any further movement of the latch holder, thereby preventing the latch holder from returning to a door opened position.

4. The door lock switch assembly as claimed in claim 3, wherein the stopper has an inversed V shape, and the V-notch has a V shape having an angle greater than the stopper, for minimizing a friction between the stopper and the V-notch when the slide moves down in releasing the latch holder, and for maintaining a positive stop of the latch holder by the stopper in the door locking.

5. The door lock switch assembly as claimed in claim 1, wherein the switching part includes;

a movable contact provided below the slide in the switch case for making the seesaw action, a fixed contact provided on one side of the movable contact parallel with the movable contact, having a fixed contact point corresponding to a moving contact point on the movable contact, and an elastic member provided in one side portion of the switch case, for providing a rotative force to the movable contact to bring both of contact points of the movable contact and the fixed contact into contact with each other in the door locking.

6. The door lock switch assembly as claimed in claim 5, wherein the elastic member is a torsion spring.

7. The door lock switch assembly as claimed in claim 5, wherein the elastic member is a coil spring.

8. The door lock switch assembly as claimed in claim 5, wherein supporting means for the seesaw movement of the moveable contact is a common contact terminal fitted below the switch case.

9. The door lock switch assembly as claimed in claim 8, wherein the common terminal includes a supporting portion inside of a top end thereof to support the movable contact, and a projection provided outside the supporting portion to prevent the movable contact from being fallen away from the common terminal.

10. The door lock switch assembly as claimed in claim 8, wherein the common terminal includes a bent portion and a recess in a center along a length direction of the common terminal to latch the common terminal in a baffle formed inside the switch case so that the common terminal cannot be fallen off from the switch case.

11. The door lock switch assembly as claimed in claim 8, wherein the common terminal includes a wire connecting portion at one side of the top end thereof, the wire connecting portion extending to forward of the plunger and being exposed to the outside of the switch cover.

12. The door lock switch assembly as claimed in claim 8, wherein the movable contact includes a projection at an edge of the center thereof to prevent the movable contact from being moved away from the common terminal toward its length direction and to limit a rotative angle of the movable contact.

13. The door lock switch assembly as claimed in claim 1, wherein the switching part includes;

a power supplying terminal at one side therof, for supplying a power to the solenoid assembly.

14. The door lock switch assembly as claimed in claim 13, wherein the power supplying terminal is provided away from the switching part in the switch case.

15. The door lock switch assembly as claimed in claim 1, wherein the slide includes a switch pushing piece on a bottom thereof on the same axis with a plunger for pushing a movable contact when the slide moves downward to open the contact points of the movable contact and a fixed contact.

16. The door lock switch assembly as claimed in claim 15, wherein the switch pushing piece includes a bottom surface sloped substantially in conformity to an angle of the movable contact tilted in a horizontal direction in a door unlocking.

17. The door lock switch assembly as claimed in claim 16, wherein a manual unlocking knob is projected to outside of the switch cover through a through hole formed in the switch cover.

18. The door lock switch assembly as claimed in claim 1, wherein the solenoid assembly includes;

a solenoid inserted in, and fixed to a fastening part in the switch case, having a power supplying terminal exposed to outside of the switch case through the switch cover, a plunger for being drawn into the solenoid when the solenoid is turned on, to move the slide backward, and a compression spring provided on a outer circumference of the plunger to move the plunger forward.

19. The door lock switch assembly as claimed in claim 1, wherein the slide includes a manual unlocking knob at one side thereof as one unit therewith for connecting with a strap to unlock the door from outside by the user forcibly.

20. The door lock switch assembly as claimed in claim 1, wherein the switching part includes;

a movable contact having a pad at a fore end, provided on one side below the slide to rotate around a hinge point by a pushing force of a switch pushing piece disposed a distance away from the center of the slide, a fixed contact provided to place a pad thereon over the pad on the movable contact so that the contact points are opened when the switch pushing piece moves down, and a power supply terminal provided at an opposite side of the movable contact with reference to the fixed contact, for supplying power to the solenoid assembly.

21. The door lock switch assembly as claimed in claim 20, wherein the movable contact is provided to pass through a through hole formed in the switch pushing piece below the slide for transmission of movements of the slide to the movable contact, directly.

22. The door lock switch assembly as claimed in claim 21, wherein the switch pushing piece includes a recess at the front end thereof to permit the moving contact point to pass through the recess, the recess having a hanging portion for preventing the movable contact from being fallen off.

* * * * *

UNITED STATES PATENT AND TRADEMARK OFFICE

CERTIFICATE OF CORRECTION

PATENT NO. : 6,603,377 B2
DATED : August 5, 2003
INVENTOR(S) : Ki Chul Cho and Seung Bong Choi It is certified that error appears in the above-identified patent and that said Letters Patent is hereby corrected as shown below:

Title page,
Item [56], References Cited, insert the following:

| | | | | |
|---|---|---|---|---|
| -- | U.S. PATENT DOCUMENTS | | | |
| 5,520,424 A | * | 5/1996 | Hapke et al. | 292/198 |
| 5,879,036 A | * | 3/1999 | Moline et al. | 292/210 |
| 4,368,530 | * | 1/1983 | Darnall, Jr. | 369/264 |
| | FOREIGN PATENT DOCUMENTS | | | |
| 1039012 A1 | 9/2000 | Europe | | |
| 0483697 A1 | 6/1992 | Europe | | |
| 0354191 A2 | 7/1990 | Europe -- | | |

Signed and Sealed this

Thirtieth Day of November, 2004

JON W. DUDAS
*Director of the United States Patent and Trademark Office*